US010196841B2

(12) United States Patent
Kitamura et al.

(10) Patent No.: US 10,196,841 B2
(45) Date of Patent: Feb. 5, 2019

(54) LID LOCKING DEVICE AND LID LOCKING MECHANISM

(71) Applicants: AISIN SEIKI KABUSHIKI KAISHA, Kariya-shi (JP); TOYOTA JIDOSHA KABUSHIKI KAISHA, Toyota-shi (JP)

(72) Inventors: Toshihiro Kitamura, Nagoya (JP); Takumi Niwa, Kariya (JP); Tatsuya Shimizu, Okazaki (JP); Masayuki Nomura, Nagakute (JP); Yoshichika Ito, Toyoake (JP)

(73) Assignees: AISIN SEIKI KABUSHIKI KAISHA, Kariya-shi (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 1136 days.

(21) Appl. No.: 14/525,670

(22) Filed: Oct. 28, 2014

(65) Prior Publication Data

US 2015/0115621 A1 Apr. 30, 2015

(30) Foreign Application Priority Data

Oct. 31, 2013 (JP) ..... 2013-226344

(51) Int. Cl.
*E05B 83/34* (2014.01)
*E05C 1/02* (2006.01)
(Continued)

(52) U.S. Cl.
CPC ..... *E05B 83/34* (2013.01); *E05B 77/38* (2013.01); *E05B 81/06* (2013.01); *E05B 81/18* (2013.01); *E05B 81/34* (2013.01); *Y10T 292/096* (2015.04)

(58) Field of Classification Search
CPC ..... E05B 83/34; E05B 81/06; E05B 81/66; E05B 81/36; E05B 81/18; E05B 79/20; E05B 77/38; E05B 85/22; Y10T 292/096
See application file for complete search history.

(56) References Cited

U.S. PATENT DOCUMENTS 7,909,371 B1 * 3/2011 Mihlbauer ..... A01K 63/006 292/288
8,616,609 B2 12/2013 Ogata et al.
(Continued)

FOREIGN PATENT DOCUMENTS

EP 2 182 148 A2 5/2010
EP 2 182 148 A3 5/2010
(Continued)

OTHER PUBLICATIONS

Notification of reasons for refusal dated Sep. 9, 2015 in Japanese Patent Application No. 2013-226344 (with English translation).

*Primary Examiner* — Kristina R Fulton
*Assistant Examiner* — Thomas L Neubauer
(74) *Attorney, Agent, or Firm* — Oblon, McClelland, Maier & Neustadt, L.L.P.

(57) ABSTRACT

In a lid locking device of the present invention, a first rod constituting portion at the front end of a rod is eccentrically located on a side of the rod which is a side spaced away from the lid at a forward extending region of the second rod constituting portion linearly movably supported at the tip cylindrical portion. Therefore, even where an engagement protrusion piece presses a side close to the lid of a tip swelling face of the first rod constituting portion, the device of the present invention is able to receive an axial force F derived from pressing force at a position closer to the central axis of the second rod constituting portion and also decrease
(Continued)

in resistance on operation of closing the lid compared to a conventionally structured device.

20 Claims, 21 Drawing Sheets

(51) Int. Cl.

| | |
|---|---|
| ***E05B 81/18*** | (2014.01) |
| ***E05B 77/38*** | (2014.01) |
| ***E05B 81/06*** | (2014.01) |
| ***E05B 81/34*** | (2014.01) |

(56) References Cited

U.S. PATENT DOCUMENTS

| | | | | |
|---|---|---|---|---|
| 2012/0248792 | A1 | 10/2012 | Ban et al. | |
| 2013/0154402 | A1* | 6/2013 | Basavarajappa ..... | B60K 15/05 310/20 |
| 2013/0341938 | A1 | 12/2013 | Niwa et al. | |

FOREIGN PATENT DOCUMENTS

| | | | |
|---|---|---|---|
| JP | 7-32798 | Y2 | 7/1995 |
| JP | 2010-106437 | A | 5/2010 |
| JP | 2010-106438 | A | 5/2010 |
| JP | 2012-30750 | | 2/2012 |
| JP | 2012-77507 | A | 4/2012 |
| JP | 2012-215055 | A | 11/2012 |
| JP | 2013-112144 | A | 6/2013 |

* cited by examiner

LID LOCKING DEVICE AND LID LOCKING MECHANISM

BACKGROUND OF THE INVENTION

1. Field of the Invention

The present invention relates to a lid locking device and a lid locking mechanism which lock a lid of a vehicle in a closed state by using a rod and, in particular, relates to a lid locking device and a lid locking mechanism for locking a lid which closes an opening of a recessed portion at which innermost side, a fuel filler opening of the vehicle, a power receiving connector and other energy obtaining portions are provided.

2. Description of the Related Art

Conventionally, as this type of lid locking device, there is known, as shown in FIG. 21, a device in which a rod 2 is pressed by a locking engaging portion 3 which protrudes toward the inside from a lid 1 to come in slide contact therewith in a process of closing the lid 1 of a vehicle, moving backward to an unlocked position and, then, moving forward to a locking position, making an engagement with the locking engaging portion, thereby, locking the lid 1 in a closed state (refer to Japanese Published Unexamined Patent Application No. 2012-30750 (FIG. 17 (b), for example).

However, in the above-described lid locking device, an outer peripheral portion of the tip face of the rod 2 which is close to the lid 1 is pressed by the locking engaging portion 3, and the rod 2 receives an axial force F derived from pressing force at a position away from the central axis J1. Thus, this causes an increase in linear motion resistance by which the rod 2 is linearly moved to result in an increased resistance on operation of closing the lid 1, which has posed a problem.

The present invention has been made in view of the above-described situation, and an object of which is to provide a lid locking device and a lid locking mechanism capable of decreasing the resistance on operation of closing a lid, as compared with conventional ones.

SUMMARY OF THE INVENTION

A lid locking device according to the the present invention for accomplishing the above-described object is a lid locking device which includes a housing which is arranged so as to be fixed on a vehicle and provided with a support hole, a rod which is arranged in such a manner that it is linearly movably assembled to the housing and urged forward, and that a front end portion thereof is, in a process of closing a lid of the vehicle, pressed by a locking engaging portion provided on the lid, moving backward to an unlocked position, then, moving forward to a locking position, making an engagement with the locking engaging portion, and locking the lid in a closed state, a supporting rod portion which is provided at an intermediate portion of the rod in the axial direction and linearly movably supported on the support hole, and an engagement rod portion which is provided as the front end portion of the rod, thinner than the supporting rod portion and eccentrically located on a side of a forward extending region of the supporting rod portion which is spaced away from the lid and at least partially overlapped with the central axis of the supporting rod portion.

In the present invention, "front" or "forward" contained in expressions such as "front end portion," "move forward" or "forward extending region" expresses for the sake of convenience one direction in which the rod moves, whereas "backward" contained in an expression of "move backward" expresses a direction opposite to the above-described expression of "front" or "forward." And these expressions such as "front" or "forward" and "backward" have nothing to do with the front and the rear of a vehicle.

DESCRIPTION OF THE PREFERRED EMBODIMENT(S)

Figure 1:
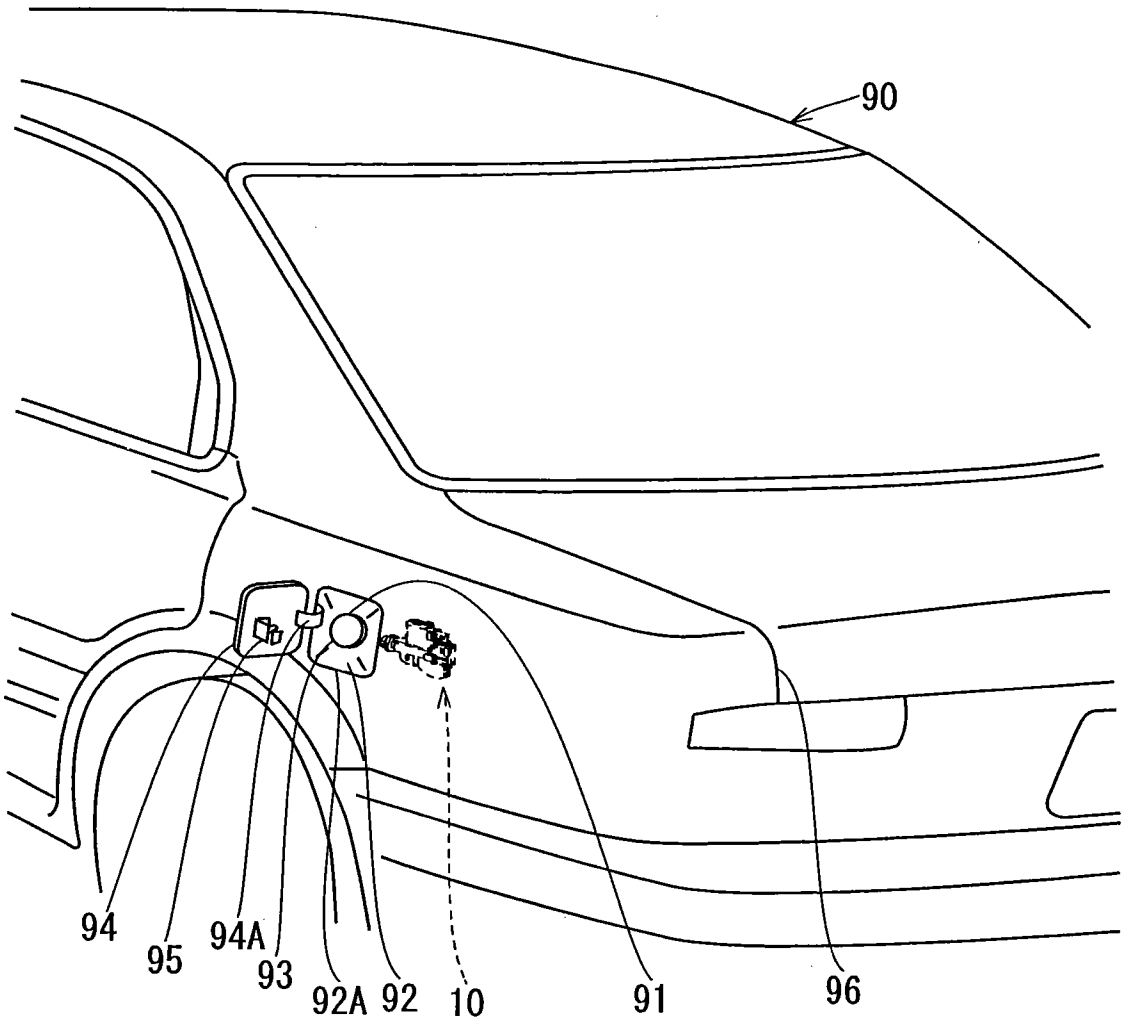
FIG. 1 is a perspective view of a vehicle on which a lid locking device of an embodiment of the present invention is mounted.

Hereinafter, a description will be given of one embodiment of the present invention by referring to FIG. 1 to FIG. 20. A fuel filler opening 91 of a vehicle 90 shown in FIG. 1 is disposed on an innermost side of a recessed portion 92 which is formed so as to be depressed at a position close to the rear of a side face of the vehicle 90 and normally closed by a fuel filler opening cap 93. An open port 92A of the recessed portion 92 is also normally closed by a lid 94. The lid 94 is fixed at the tip of a curved arm 94A coupled to the front inner face of the recessed portion 92 so as to move rotationally and opened outside the recessed portion 92. Further, when the lid 94 is closed, an outer face of the lid 94 is flush with an entire outer face of the vehicle 90. Still further, the lid 94 is urged so as to be opened by an elastic member which is not illustrated.

In addition, in describing each individual position and each individual component given below, the front side of the vehicle 90 is simply referred to as "the front," the opposite side thereof is simply referred to as "the rear," and a transverse direction of the vehicle 90 is simply referred to as "transverse direction."

Figure 2:
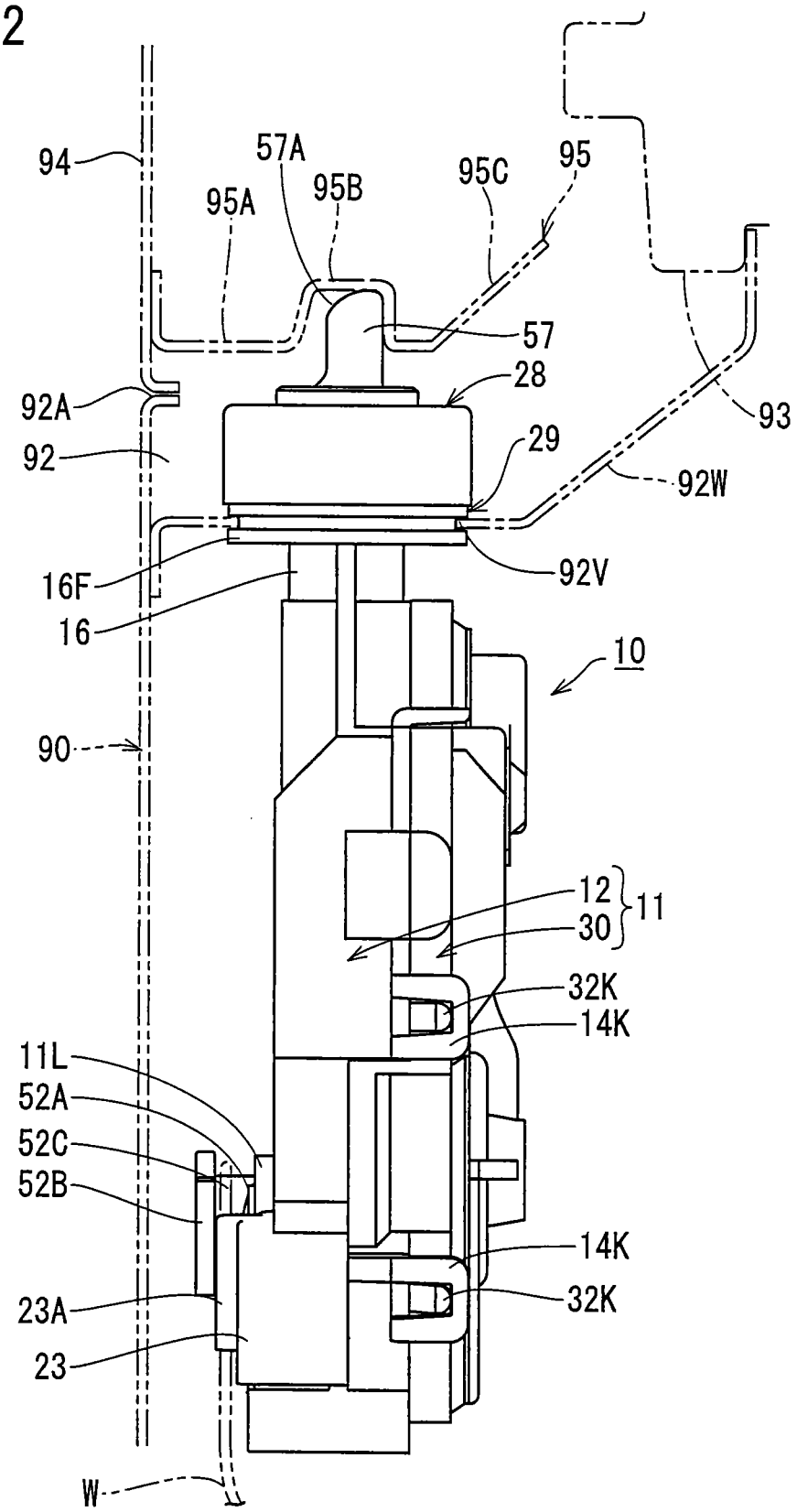
FIG. 2 is a plan view of the lid locking device.

An engagement protrusion piece 95 (corresponding to the "locking engaging portion" of the present invention) protrudes into the recessed portion 92 from an inner face of the lid 94. As shown in FIG. 2, the engagement protrusion piece 95 is provided with a rod abutting portion 95A which protrudes from the inner face of the lid 94 in a substantially perpendicular manner, an engagement recessed portion 95B which is formed by bending a position close to the tip of the rod abutting portion 95A to the front in an angular groove shape, and a tip guide portion 95C which extends obliquely forward from a tip portion of the rod abutting portion 95A. A lid locking device 10 of the present invention is provided at the vehicle 90 in order to engage with the engagement protrusion piece 95 to lock the lid 94 in a closed state (a state shown in FIG. 2).

The lid locking device 10 is constructed by assembling a plurality of components to a housing 11 and assembled rearward of an internal side wall 92W of the recessed portion 92. Only a front end portion of the lid locking device 10 protrudes forward from an inner side face in the rear of the recessed portion 92 by way of a through hole 92V formed on the internal side wall 92W.

Figure 3:
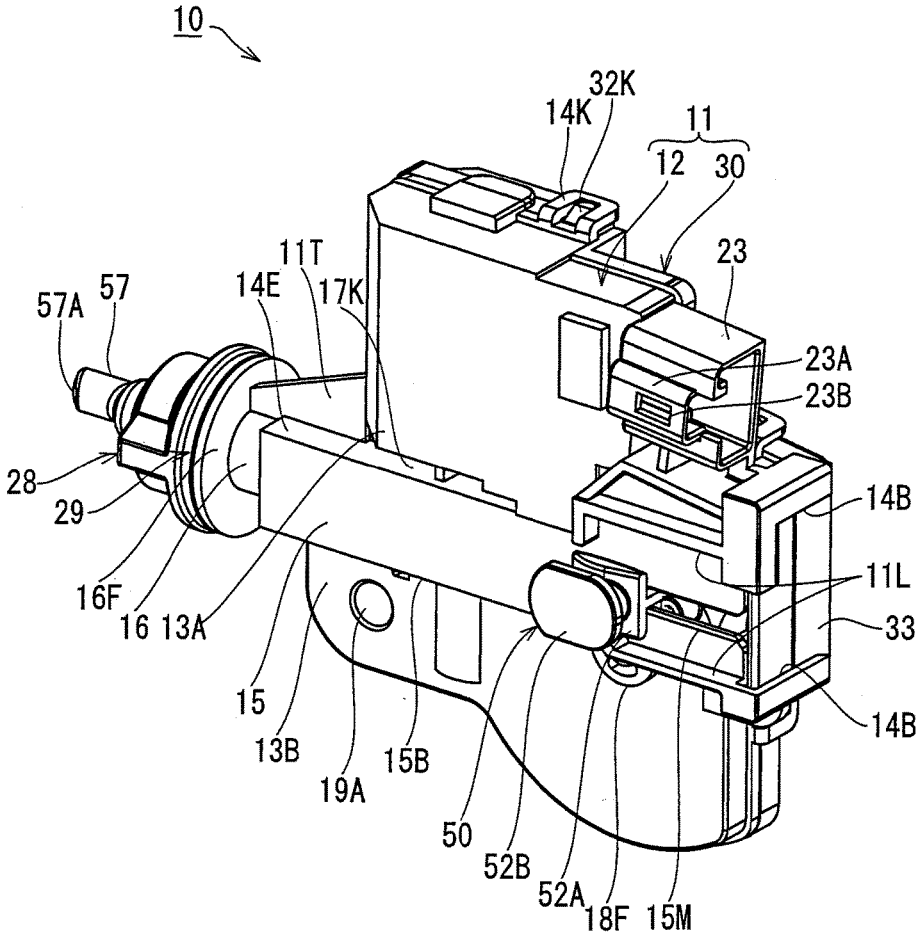
FIG. 3 is a perspective view of the lid locking device when viewed obliquely from the rear.
Figure 4:
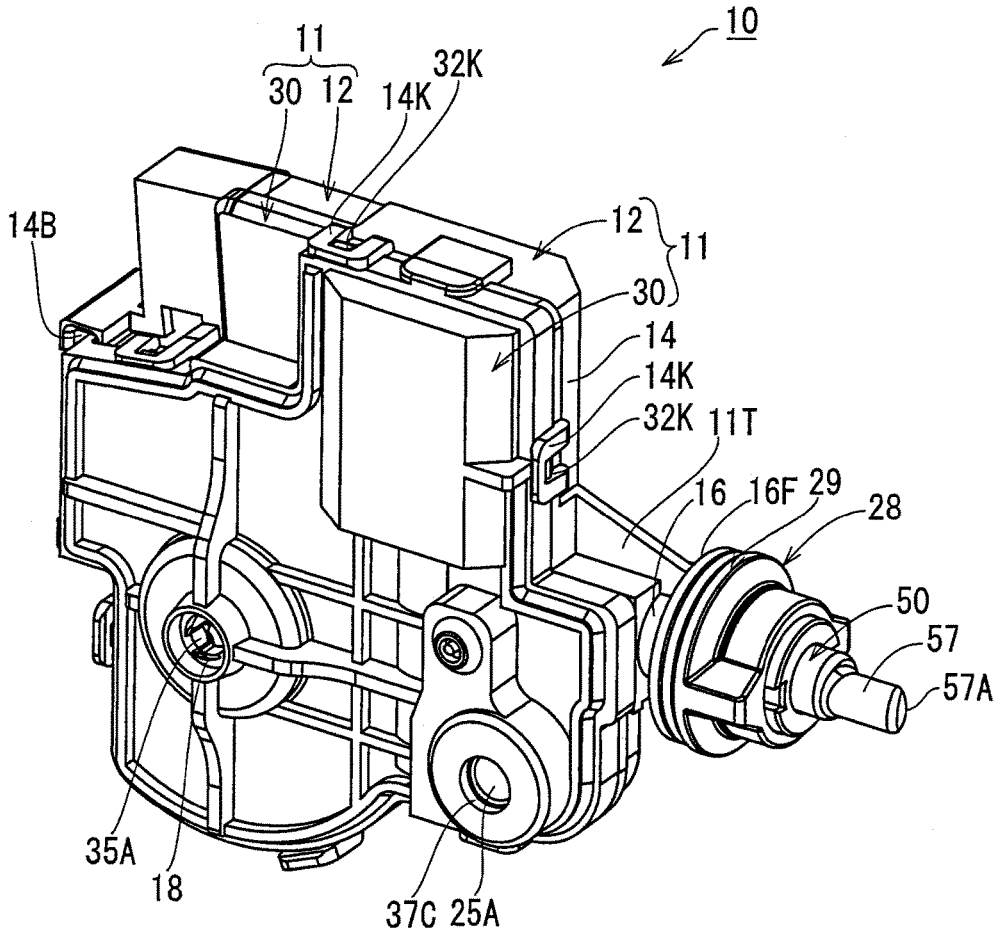
FIG. 4 is a perspective view of the lid locking device when viewed obliquely from the front.
Figure 5:
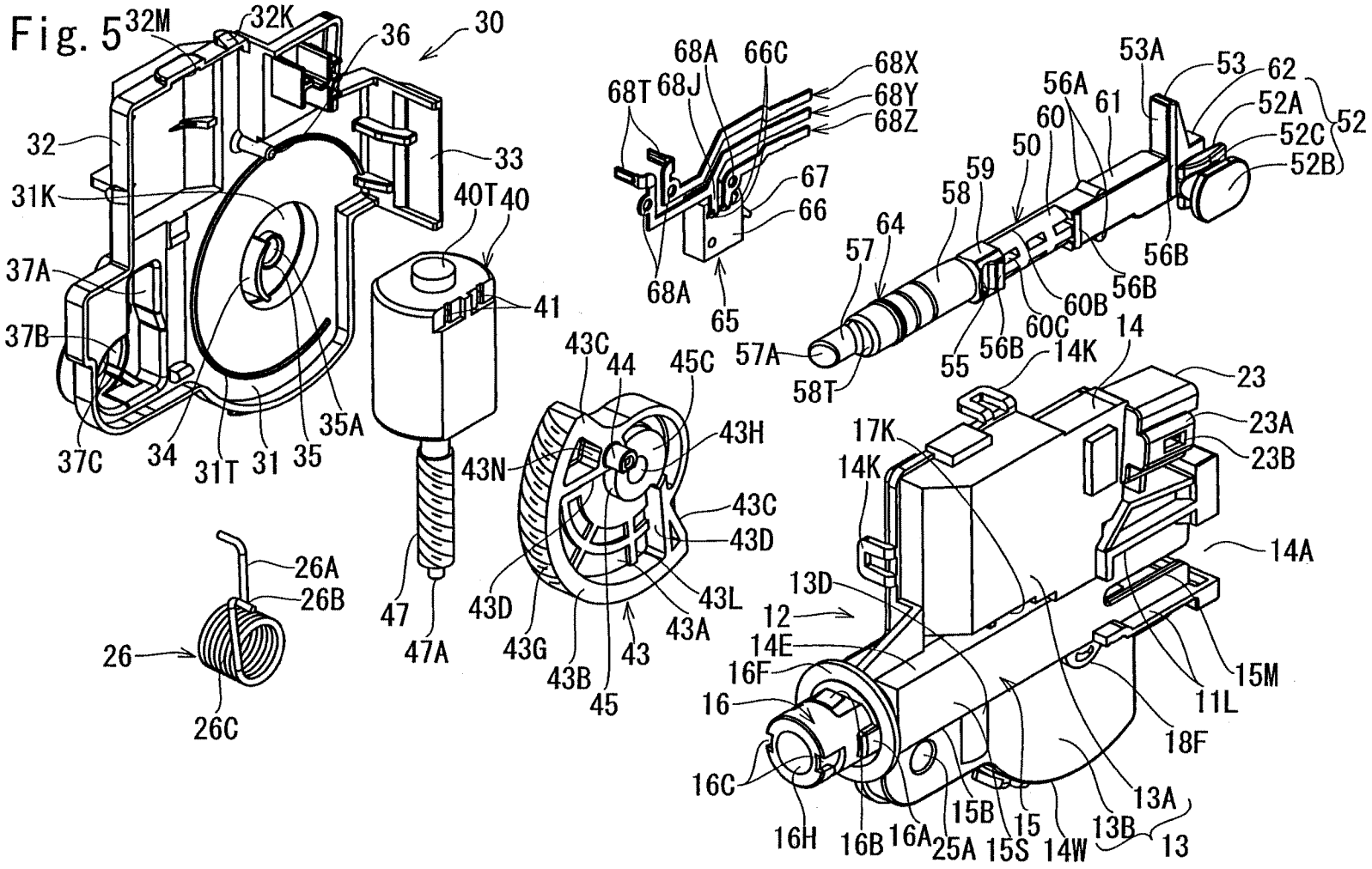
FIG. 5 is an exploded perspective view of the lid locking device.

As shown in FIG. 3 and FIG. 4, the housing 11 of the lid locking device 10 is structured to be a casing which is flat in the transverse direction and also divided into two portions, that is, a main housing 12 and a sub-housing 30 in the transverse direction. As shown in FIG. 5, the main housing 12 is structured in such a manner that a main side wall 14 protrudes from an outer peripheral portion of a main plate portion 13. On the other hand, the sub-housing 30 is structured in such a manner that a sub-side wall 32 lower than the main side wall 14 protrudes from an outer peripheral portion of a sub-plate portion 31 opposite to the main plate portion 13. The sub-housing 30 is used as a lid for closing a space surrounded by the main side wall 14 of the main housing 12. Further, a portal locking piece 14K protrudes toward the sub-housing 30 from a plurality of positions on an outer face of the main side wall 14. Correspondingly thereto, a locking protrusion 32K is provided on a plurality of positions on an outer face of the sub-side wall 32. As shown in FIG. 3, the main housing 12 and the sub-housing 30 are held in a united state by the engagement between the locking piece 14K and the locking protrusion 32K.

Figure 6:
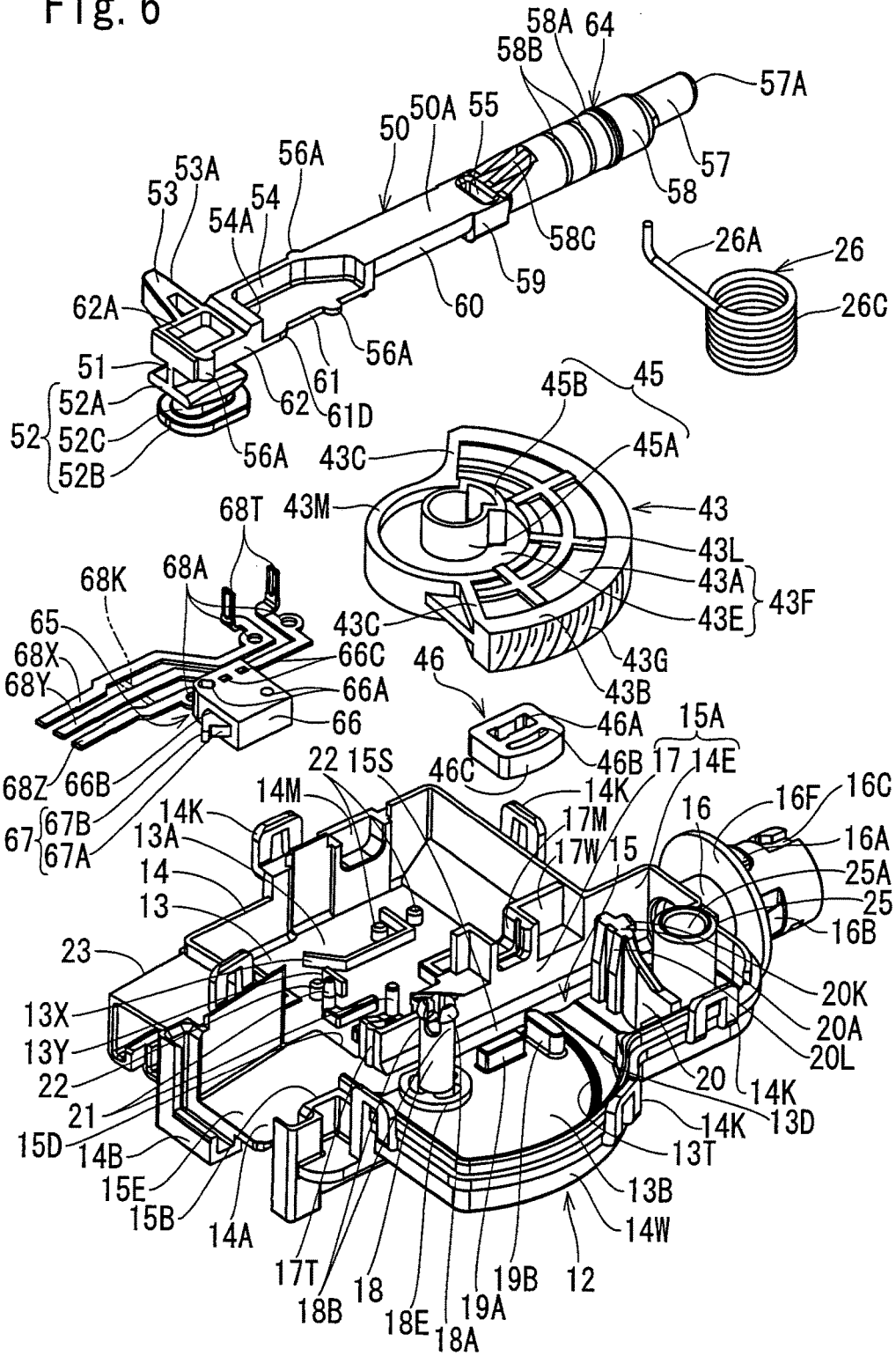
FIG. 6 is an exploded perspective view of the lid locking device.

As shown in FIG. 6, a guide groove portion 15 formed in an angular groove shape to extend in a front-back direction is provided at substantially the center in a vertical direction of the main plate portion 13. The main plate portion 13 is demarcated by the guide groove portion 15 into an upper main plate portion 13A and a lower main plate portion 13B.

More specifically, the main plate portion 13 is such that a vertical middle portion thereof is bent in a step-wise manner and a step portion thereof is given as a lower groove side wall 15B of a pair of groove side walls 15A, 15B (refer to FIG. 5) opposed to each other at the guide groove portion 15 in the vertical direction. A lower portion from the groove side wall 15B is given as a lower main plate portion 13B which is shifted in a stepwise manner toward the sub-plate portion 31 with respect to an upper portion. Further, a vertical partition wall 17 which is opposed from above to the lower groove side wall 15B and also extends in the front-back direction protrudes from an inner face of the main plate portion 13. A groove side wall 15A on an upper side of the guide groove portion 15 is composed of the vertical partition wall 17 and a groove constituting portion 14E which is a part of the main side wall 14 and extends on a front extension line of the vertical partition wall 17.

The vertical partition wall 17 is opposed to the lower groove side wall 15B in a range from a position close to the rear end thereof to a position close to the front end thereof, and the groove constituting portion 14E of the main side wall 14 extending forward of the vertical partition wall 17 is opposed to the lower groove side wall 15B in a range from the position close to the front end thereof to the front end thereof. Further, the lower groove side wall 15B extends backward longer than the upper groove side wall 15A. An upper portion from the vertical partition wall 17 of the main plate portion 13 is given as the above-described upper main plate portion 13A, and the upper main plate portion 13A is shifted toward the side slightly away from the sub-housing 30 with respect to a groove bottom wall 15S of the guide groove portion 15. Further, a contacting protruding strip 17T which has a semi-circular cross section and extends in the transverse direction is formed on a rear end face of the vertical partition wall 17. Still further, a motor opposing wall 17W protrudes toward the sub-housing 30 from the front part of the vertical partition wall 17, and a motor positioning groove 17M is formed so as to cut a middle portion of the motor opposing wall 17W.

In addition, the vertical partition wall 17 is made thicker than the main side wall 14, and a void portion 17K which is opened toward an outer face of the main plate portion 13 is formed midway in the thickness direction thereof, as shown in FIG. 5.

As shown in FIG. 6, the groove bottom wall 15S of the guide groove portion 15 extends continuously to the rear end of the lower groove side wall 15B. Further, a rear end flat-plate portion 15E formed by extending the groove bottom wall 15S upward is provided in the rear of the vertical partition wall 17. An upper end portion of the rear end flat-plate portion 15E is positioned midway in the vertical direction of the upper main plate portion 13A. A step portion 15D between the rear end flat-plate portion 15E and the upper main plate portion 13A extends straight upward from the rear end portion of the vertical partition wall 17, then bends backward at a right angle and extends up to an intermediate portion of the upper edge portion of the vertical partition wall 17.

At the upper portion from the guide groove portion 15, the main side wall 14 extends forward along the upper edge portion of the rear end flat-plate portion 15E to a middle point from the rear end thereof, extending upward, forward and downward from there along a rear edge portion, an upper edge portion and a front end edge of the upper main plate portion 13A and connecting with the front end portion of the vertical partition wall 17. As described previously, the groove constituting portion 14E of the main side wall 14 extends forward of the vertical partition wall 17, constitutes a part of the upper groove side wall 15A. And, the front end portion of the groove constituting portion 14E is bent at a right angle, coming across the front end of the guide groove portion 15.

The main side wall 14 of the lower portion from the guide groove portion 15 is provided at a position close to the rear end thereof with a gear cover curved portion 14W which swells downward. Further, the main side wall 14 extends forward from the front end portion of the gear cover curved portion 14W and then extends upward in the perpendicular direction, and connects with the front end portion of the lower groove side wall 15B. The main side wall 14 also extends from the rear end portion of the gear cover curved portion 14W upward in the perpendicular direction and then extends backward along the lower groove side wall 15B.

Figure 8:
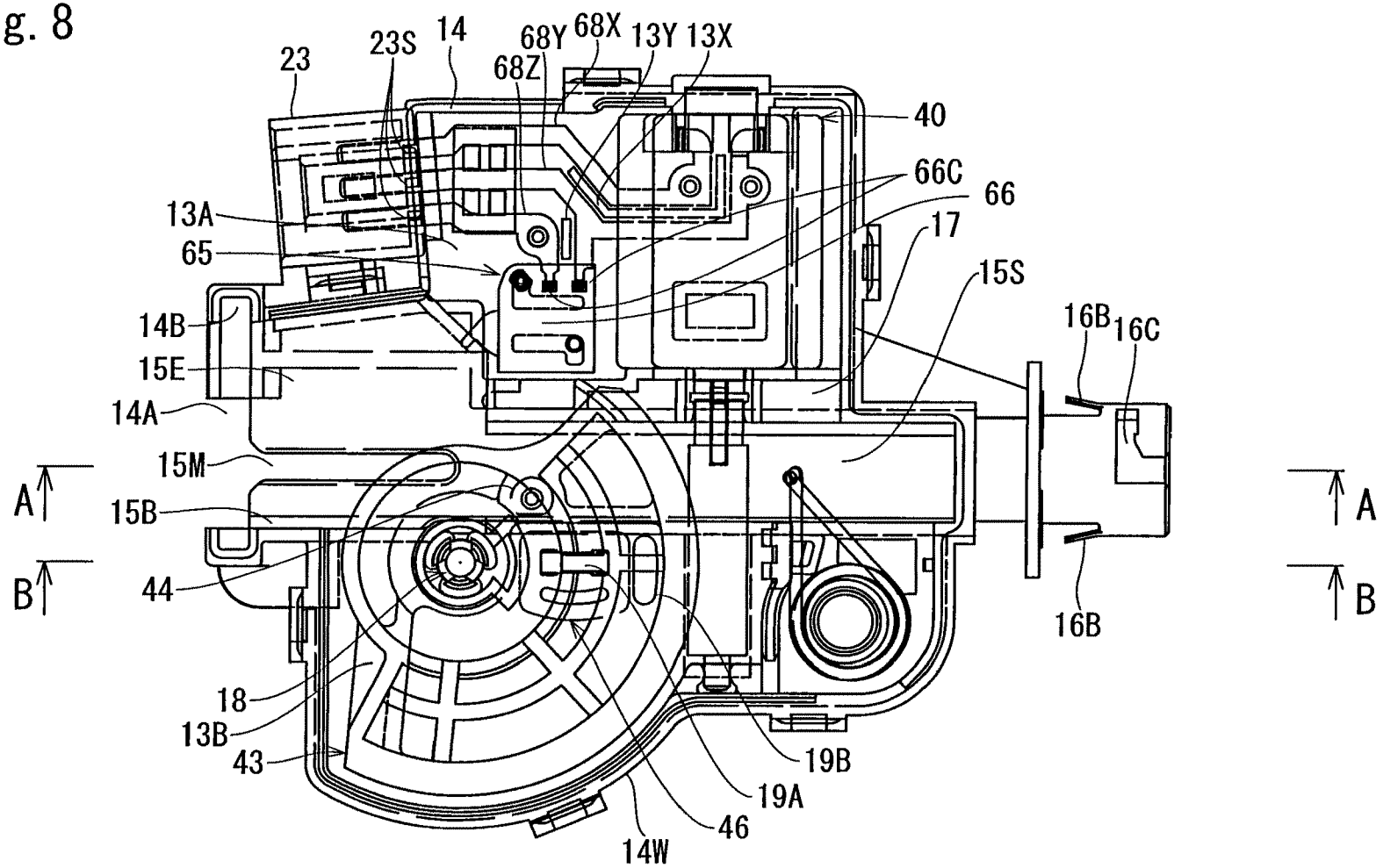
FIG. 8 is an internal side view of the lid locking device.

A rod passing port 14A formed by cutting the main side wall 14 is provided in the rear of the guide groove portion 15 and rear end flat-plate portion 15E. Further, as shown in FIG. 8, at the center of the groove bottom wall 15S in the width direction, a guide slit 15M extends from the rear end of the groove bottom wall 15S to a position before the vertical partition wall 17. As shown in FIG. 3, the rod passing port 14A (refer to FIG. 6) and a rear end opening of the guide slit 15M are closed by a closing protruding piece 33 which protrudes from the rear end portion of the sub-housing 30 toward the main housing 12. Further, as shown in FIG. 6, a protrusion-piece engaging groove 14B with which an edge portion of the closing protruding piece 33 is engaged in a sliding manner is formed at a pair of rear end edges of the main side wall 14 which oppose each other vertically across the rod passing port 14A of the main housing 12 and at a part of the rear end edge of the rear end flat-plate portion 15E.

In addition, as shown in FIG. 3, a reinforcing rib 11L which extends on both sides of the guide slit 15M in the front-back direction is provided on an outer face of the main housing 12.

As shown in FIG. 8, a substantially square tube-shaped male connector hood 23 protrudes from an outer face of the main side wall 14 above the rear end flat-plate portion 15E. Further, a plurality of bus bar insertion slits 23S for inserting a first to a third bus bar 68X, 68Y and 68Z to be described later are formed at a part surrounded by the male connector hood 23 of the main side wall 14.

In addition, as shown in FIG. 3, on one side wall of the male connector hood 23, there is formed an angular groove portion 23A which extends in the front-back direction, with a middle portion in the width direction of the side wall being raised outside. And, a rectangular locking hole 23B is formed at a middle portion of the angular groove portion 23A. A female connector (not illustrated) is fitted into the male connector hood 23 and a protrusion of an engagement arm provided on the female connector is locked into the locking hole 23B.

As shown in FIG. 6, a tip cylindrical portion 16 extends forward from an outer face of the part of the main side wall 14 which comes across the front end of the guide groove portion 15. An inner space of the tip cylindrical portion 16 is given as a support hole 16H of the present invention (refer to FIG. 5) and communicatively connected to an inner space of the guide groove portion 15. Further, a disk shaped flange 16F swells out from a middle point of the tip cylindrical portion 16 in the axial direction. As shown in FIG. 5, a pair of engagement protrusion portions 16A and a pair of engagement warping pieces 16B are formed on the flange 16F side on an outer circumferential face of a part forward from the flange 16F in the tip cylindrical portion 16, and a pair of engaging grooves 16C, 16C are formed at a tip side which is away from the flange 16F. In addition, as shown in FIG. 4, a space between the main side wall 14 provided at the front end portion of the upper main plate portion 13A and a part rearward from the flange 16F in the tip cylindrical portion 16 is connected by a reinforcing rib 11T.

Figure 7:
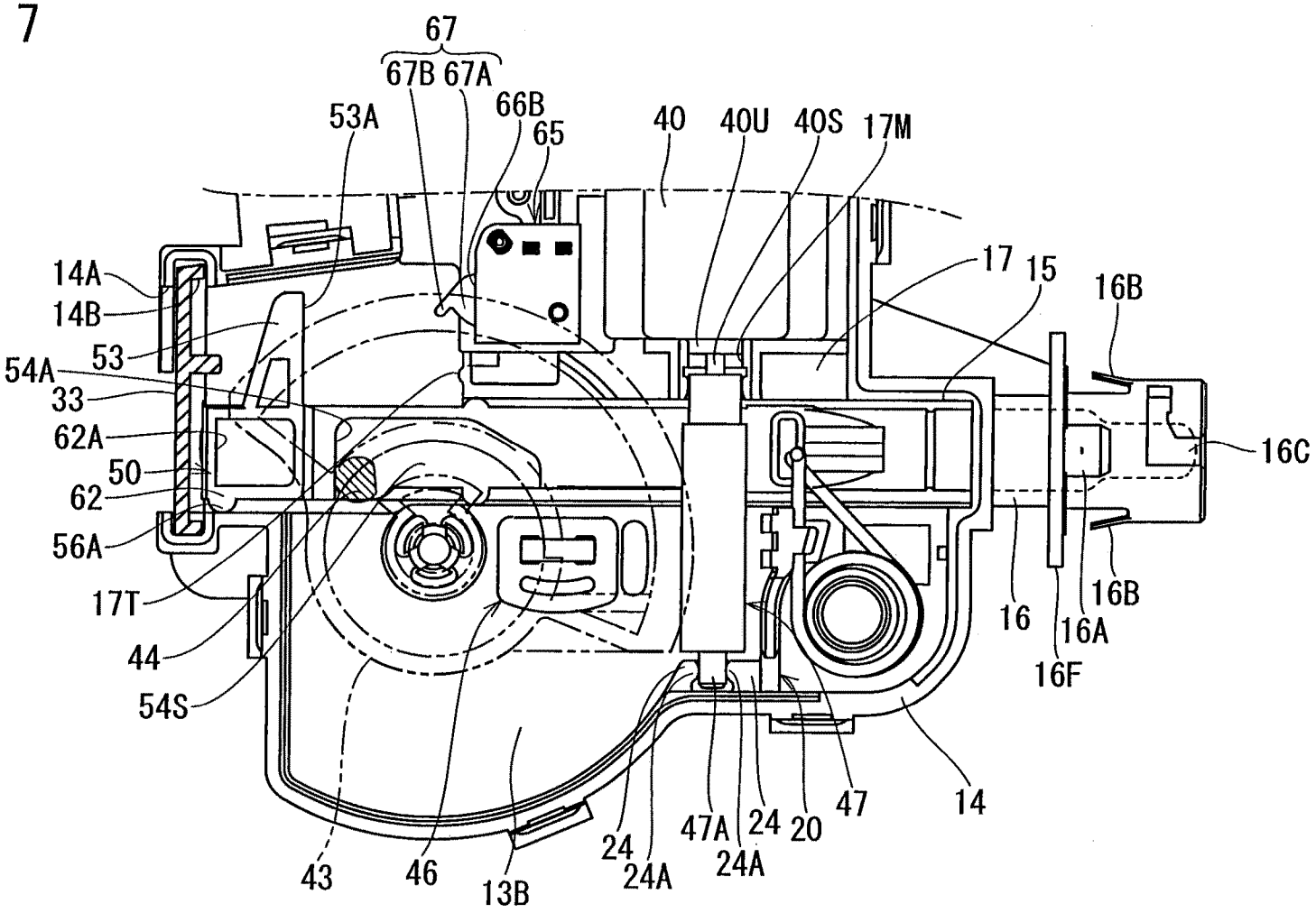
FIG. 7 is an internal side view of the lid locking device in a state that a rod is positioned before a rear-end limit position.

The engagement protrusion portion 16A and the engagement warping piece 16B are alternately arrayed, with an interval of 90 degrees in a circumferential direction of the tip cylindrical portion 16. Further, the engagement protrusion portion 16A assumes a rectangular shape when viewed in the diametrical direction of the tip cylindrical portion 16 and protrudes as a whole in a stepwise manner from the outer circumferential face of the tip cylindrical portion 16. Still further, the rear end of the engagement protrusion portion 16A is connected to the flange 16F (refer to FIG. 7). On the other hand, as shown in FIG. 7, the engagement warping piece 16B has a protrusion structure which gradually swells out to the rear from the outer circumferential face of the tip cylindrical portion 16. Further, as shown in FIG. 5, the pair of engaging grooves 16C, 16C are formed in an axial symmetry at two positions which are spaced away at 180 degrees in the circumferential direction of the tip cylindrical portion 16. As shown in FIG. 7, each engaging groove 16C assumes an L-letter shape which extends straight from the tip of the tip cylindrical portion 16 to the rear in an axial direction and bends at right angle.

A retaining sleeve 28 shown in FIG. 2 is fitted outside the tip of the tip cylindrical portion 16, and a pair of engagement protrusion portions (not illustrated) formed on an inner face of the retaining sleeve 28 are engaged with the engaging grooves 16C, 16C and thereby retained. The housing 11 is fixed on the internal side wall 92W in a state that an opening edge of the through hole 92V on the previously described internal side wall 92W is held between the retaining sleeve 28 and the flange 16F of the tip cylindrical portion 16. The tip cylindrical portion 16 comes to a state that only the tip portion thereof protrudes from the tip face of the retaining sleeve 28.

In addition, a notch (not illustrated) is formed at two sites at the opening edge of the through hole 92V. The housing 11 is turned after the engagement protrusion portions 16A, 16A is inserted into the notches, by which the engagement protrusion portions 16A, 16A are locked at the opening edge of the through hole 92V. Further, the engagement warping pieces 16B, 16B come in slide contact with the opening edge of the through hole 92V, warped, then, returned elastically and locked at the opening edge of the through hole 92V. Still further, a packing 29 is held between the retaining sleeve 28 and the opening edge of the through hole 92V.

As shown in FIG. 6, a gear supporting shaft 18 protrudes from an inner face of the lower main plate portion 13B. The gear supporting shaft 18 is formed independently from the main plate portion 13 and assumes a solid cylindrical structure as a whole, excluding a tip portion thereof, and the tip portion is structured in such a manner that the cylindrical body is vertically divided into a plurality of warping pieces 18B. A tip engagement protrusion portion 18A is provided at a tip outer face of each of the warping pieces 18B. Further, each of the tip engagement protrusion portions 18A is gradually increased in amount of protrusion from the outer face of the warping piece 18B with closer distance to the base end of the warping piece 18B.

Figure 10:
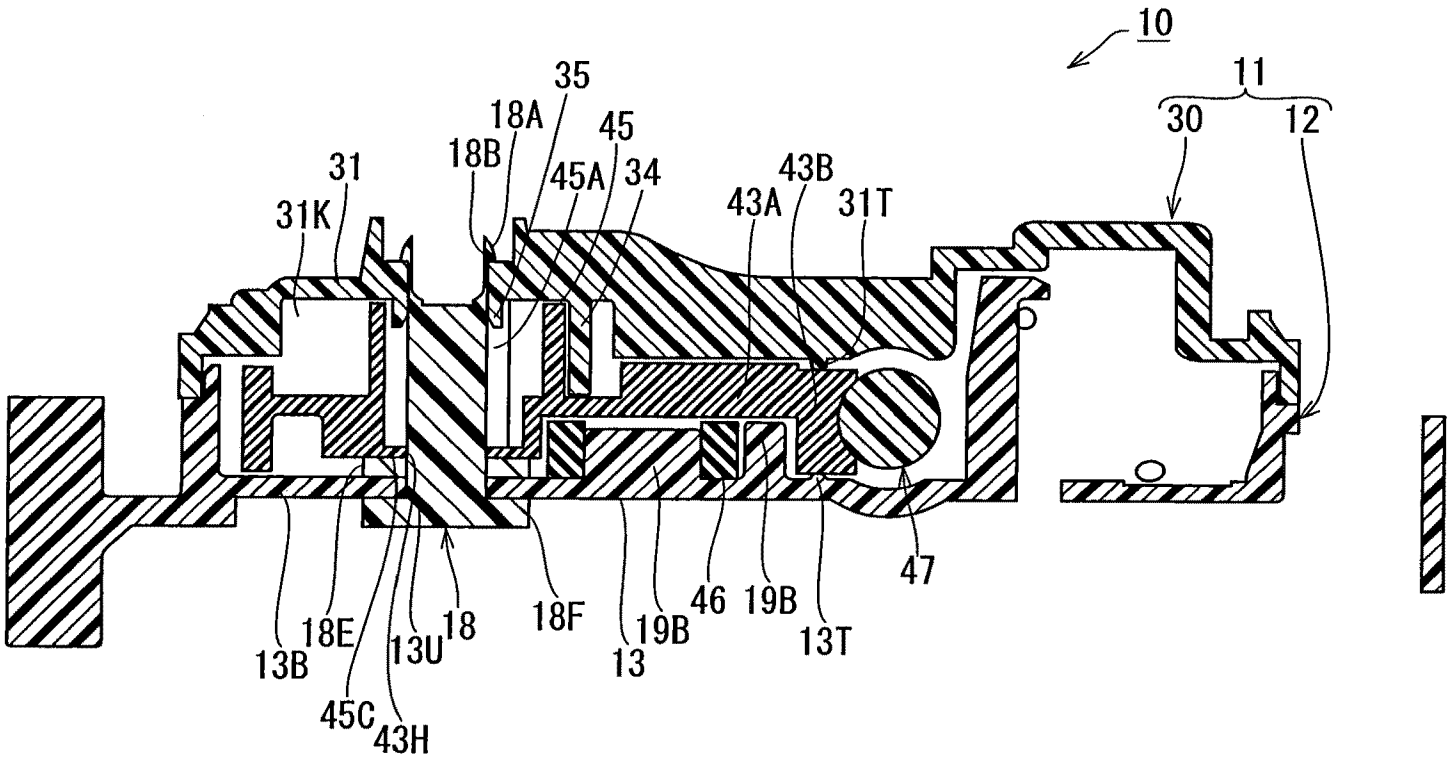
FIG. 10 is a planar cross-sectional view which is taken along the line B-B in FIG. 8.

A flange 18F (refer to FIG. 5) swells out laterally from a base end portion of the gear supporting shaft 18. As shown in FIG. 10, the gear supporting shaft 18 is inserted from outside into a through hole 13U which is formed close to the rear end of the upper end edge of the lower main plate portion 13B. And, an E ring 18E is press-fitted from the tip of the gear supporting shaft 18 and the lower main plate portion 13B is in a state of being held between the flange 18F and the E ring 18E. The gear supporting shaft 18 is fixed to the lower main plate portion 13B.

As shown in FIG. 5, a circular depressed portion 31K is formed co-axially with the gear supporting shaft 18 (refer to FIG. 6) on the sub-housing 30. The circular depressed portion 31K is formed by depressing a part of the inner face of the sub-plate portion 31 in a circular shape, and a shaft supporting hole 35A passes through the center of an innermost face of the circular depressed portion 31K. And, the tip portion of the gear supporting shaft 18 is pressed into the shaft supporting hole 35A, while warping the warping piece 18B. As shown in FIG. 10, a group of the tip engagement protrusion portions 18A is locked from outside at the opening edge of the shaft supporting hole 35A.

In addition, as shown in FIG. 5, a center protrusion portion 35 protrudes toward the main housing 12 from the opening edge of the shaft supporting hole 35A. Further, a circular-arc protrusion piece 34 which is curbed around the shaft supporting hole 35A protrudes from a part forward from the shaft supporting hole 35A on the innermost face of the circular depressed portion 31K.

As shown in FIG. 8, a worm wheel 43 to be described later in detail is rotatably provided on the gear supporting shaft 18. Further, the previously described gear cover curved portion 14W of the main side wall 14 is given as a circular arc around the gear supporting shaft 18 and slightly greater in diameter than the worm wheel 43.

As shown in FIG. 6, a slide-contact circular-arc protruding strip 13T which is formed in a circular arc-shape around the gear supporting shaft 18 is formed on the inner face of the lower main plate portion 13B. The slide-contact circular-arc protruding strip 13T is also formed extending to a position close to the rear end of the vertical partition wall 17. Further, as shown in FIG. 5, a slide-contact circular-arc protruding strip 31T similar to the slide-contact circular-arc protruding strip 13T is formed about the shaft supporting hole 35A on the inner face of the sub-plate portion 31 as well. The worm wheel 43 to be described later rotates, while being in slide contact with the slide-contact circular-arc protruding strips 13T, 31T.

A first and a second rotational movement regulating protrusion 19A, 19B are provided forward of the gear supporting shaft 18 in the upper edge portion of the lower main plate portion 13B and at an inner part of the slide-contact circular-arc protruding strip 13T. The first rotational movement regulating protrusion 19A is disposed forward of the gear supporting shaft 18, the cross sectional shape of which is a rectangular shape extending in the front-back direction along an edge of the guide groove portion 15. On the other hand, the second rotational movement regulating protrusion 19B is disposed forward of the first rotational movement regulating protrusion 19A, the cross sectional shape of which is a shape in which rectangular both ends extending downward from the edge of the guide groove portion 15 are rounded into a circular-arc shape.

Figure 11:
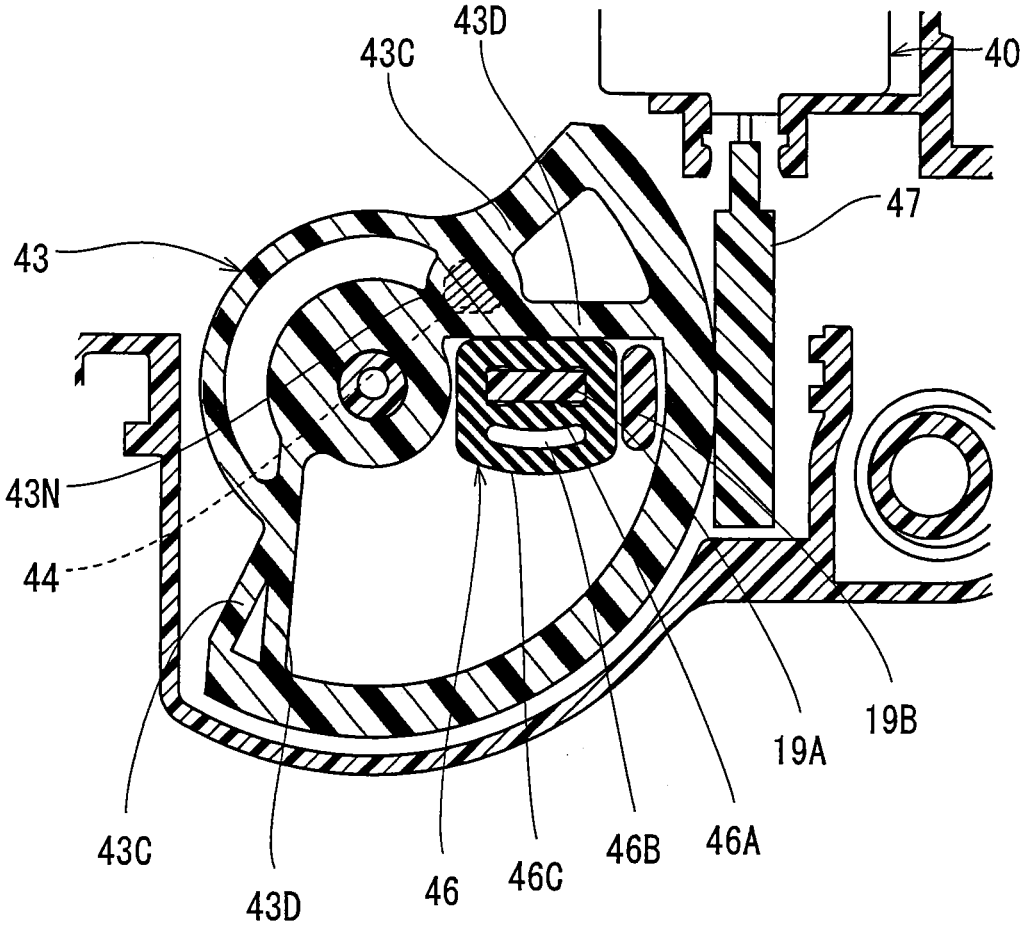
FIG. 11 is a side cross-sectional view of the lid locking device in a state that a worm wheel is disposed at a forward rotation limit position.

As shown in FIG. 11, a cushion rubber 46 is provided on the first rotational movement regulating protrusion 19A. As shown in FIG. 6, the cushion rubber 46 is structured in such a manner that one side face of a rubber piece having a substantially rectangular outer edge shape is given as a curved side face 46C which is curved so as to swell outside, and an installation hole 46A and a buffer hole 46B are arrayed between the curved side face 46C and a side face on the opposite side thereof. Further, the buffer hole 46B is disposed on the curved side face 46C side and formed in a long hole shape which is curved in parallel with the curved side face 46C. On the other hand, the installation hole 46A is formed in a long hole shape which extends in parallel with a side face on the opposite side of the curved side face 46C and both ends thereof in the longitudinal direction are made slightly wider. As shown in FIG. 11, the first rotational movement regulating protrusion 19A is fitted into the installation hole 46A, and the buffer hole 46B is disposed on a side away from the guide groove portion 15 in relation to the installation hole 46A. Further, the second rotational movement regulating protrusion 19B is adjacent by way of a slight clearance to one side face which is laterally next to the curved side face 46C of the cushion rubber 46.

As shown in FIG. 6, a step portion 13D is provided at a middle position of the lower main plate portion 13B in the front-back direction, and a part forward from the step portion 13D of the lower main plate portion 13B is shifted toward the sub-plate portion 31 in relation to a rear part thereof. A reinforcing wall 20 protrudes from a part forward from the step portion 13D on the inner face of the lower main plate portion 13B. The reinforcing wall 20 is formed in a plate shape which extends vertically to partition the main plate portion 13 into the front and the rear. Further, the guide groove portion 15 side of the reinforcing wall 20 protrudes greatly from the lower main plate portion 13B in relation to the main side wall 14 side and is given as a reinforcing main portion 20A. A pair of ribs 20L, 20L are formed on a rear face of the reinforcing main portion 20A, and a locking protrusion 20K protrudes forward from the tip on the front face of the reinforcing main portion 20A.

A cylindrical column 25 protrudes from a part forward from the reinforcing wall 20 in the lower main plate portion 13B. The cylindrical column 25 is equal in height to the reinforcing main portion 20A. The main housing 12 is integrated with the sub-housing 30, by which the tip portion of the reinforcing wall 20 is fitted into a first front end recessed portion 37A (refer to FIG. 5) formed on the inner face of the sub-housing 30, and the tip portion of the cylindrical column 25 is also fitted into a second front end recessed portion 37B (refer to FIG. 5) formed on the inner face of the sub-housing 30. Further, a through hole 25A inside the cylindrical column 25 passes through the housing 11 in a lateral direction by way of a through hole 37C (refer to FIG. 4) which is formed at the center of the second front end recessed portion 37B, and the lid locking device 10 is fixed to the vehicle 90 by a bolt inserted therethrough.

As shown in FIG. 7, a rod 50 is linearly movably accommodated at the guide groove portion 15. As shown in FIG. 6, the rod 50 extends in the front-back direction and is provided with a first to a sixth rod constituting portion 57 to 62 arrayed sequentially from the front end to the rear end.

Figure 9:
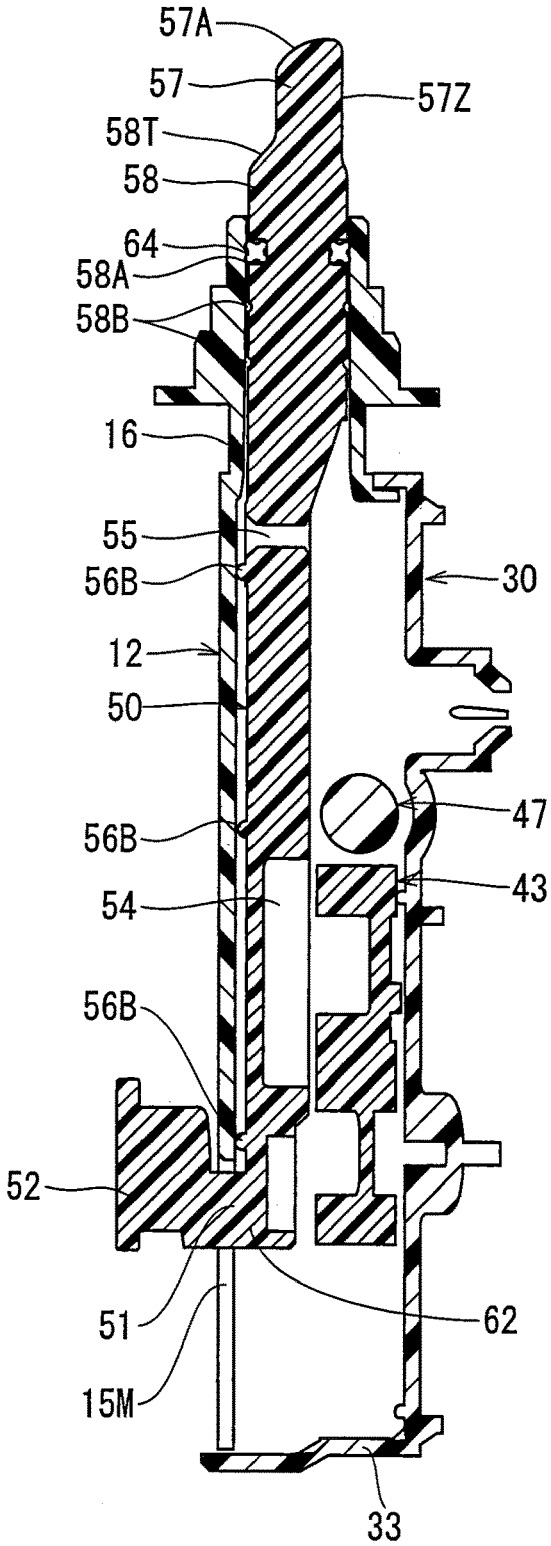
FIG. 9 is a planar cross-sectional view which is taken along the line A-A in FIG. 8.

The second rod constituting portion 58 corresponds to the "supporting rod portion" of the present invention and is formed in a circular cross section and extends in the front-back direction, with an outer diameter thereof made slightly smaller than an inner diameter of the tip cylindrical portion 16. Further, as shown in FIG. 9, a seal ring groove 58A is formed at a position close to the front end on an outer face of the second rod constituting portion 58, and a pair of annular grooves 58B, 58B are formed in the rear thereof. A seal ring 64 is provided on the seal ring groove 58A. In addition, as shown in FIG. 6, an inclined face 58C is formed on the opposite side of the groove bottom wall 15S (the sub-plate portion 31 side) at the rear end portion of the second rod constituting portion 58 in such a manner as to approach backward to the center of the second rod constituting portion 58.

Figure 13:
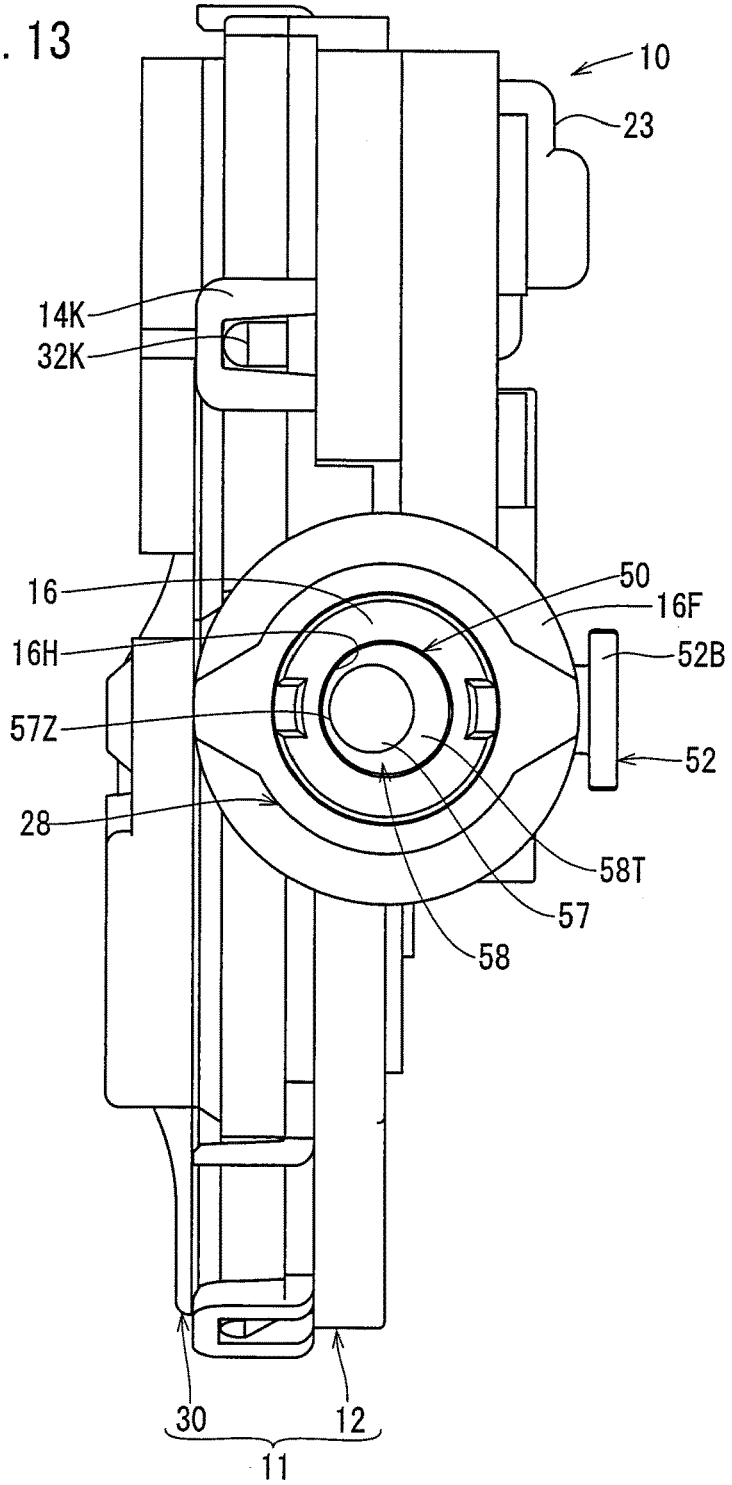
FIG. 13 is a front view of the lid locking device.
Figure 16A:
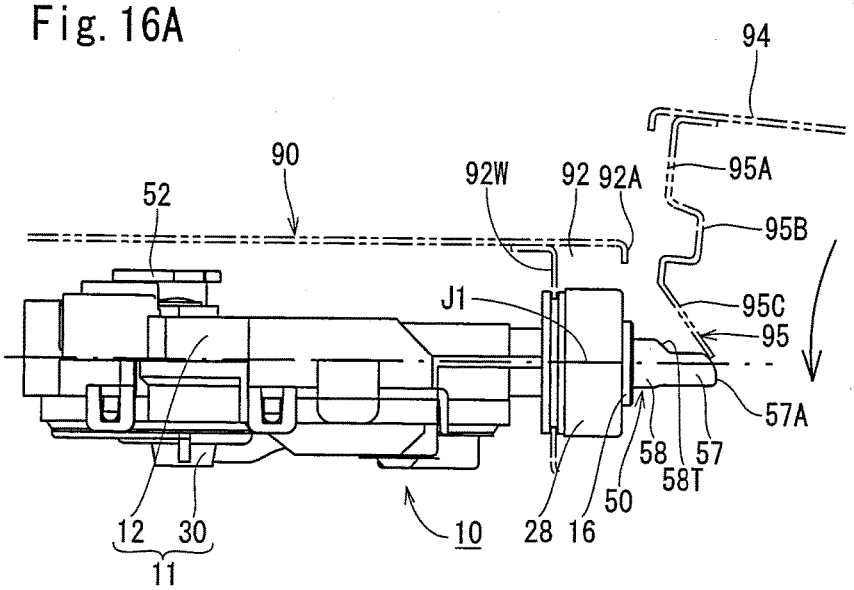
FIG. 16A is a plan view which shows the lid locking device in a state that the rod is disposed at the origin position.

The first rod constituting portion 57 corresponds to the "engagement rod portion" of the present invention, and is formed so as to have a circular cross section smaller in diameter than the second rod constituting portion 58 (for example, a circular cross section with a diameter of about half the second rod constituting portions 58), extending in the front-back direction. The first rod constituting portion 57 is shorter in length than the second rod constituting portion 58. Further, as shown in FIG. 5, the central axis of the first rod constituting portion 57 is shifted from the central axis of the second rod constituting portions 58. More specifically, as shown in FIG. 13, in the vertical direction, the central axis of the first rod constituting portion 57 is disposed at the same position as the central axis of the second rod constituting portion 58. As shown in FIG. 16A, in the transverse direction, the central axis of the first rod constituting portion 57 is disposed so as to be shifted to a side away from the lid 94 (away from the groove bottom wall 15S) in relation to the central axis of the second rod constituting portion 58.

Further, as shown in FIG. 9, the tip portion of the second rod constituting portion 58 is given as a rounded diameter-reducing portion 58T, and the diameter reducing portion 58T is formed in a closed ring shape which surrounds an entire base end portion of the first rod constituting portion 57. Here, where such a structure is provided that a circle which is the cross section of the first rod constituting portion 57 is inscribed with a circle which is the cross section of the second rod constituting portion 58 when the rod 50 is viewed in the axial direction, a border between the second rod constituting portion 58 and the first rod constituting portion 57 is complicated in shape in manufacturing the rod 50. And, this poses a problem. In the lid locking device 10 of the present embodiment, as shown in FIG. 13, such a structure is provided that the diameter reducing portion 58T is made annular so as to surround an entire base end portion of the first rod constituting portions 57 and the circle of the cross section of the first rod constituting portion 57 is inwardly spaced away from the circle of the cross section of the second rod constituting portion 58, thereby solving the above problem.

Further, a position of the outer circumferential face of the first rod constituting portion 57 which is closest to the circle of the cross section of the second rod constituting portion 58 is given as a hole-inner face opposing portion 57Z of the present invention and adjoins the inner face of the tip cylindrical portion 16 (the inner face of the support hole 16H) in a state that the first rod constituting portion 57 is inserted within the tip cylindrical portion 16. If the first rod constituting portion 57 is pressed by the engagement protrusion piece 95 and may possibly be deformed as will be described later, the hole-inner face opposing portion 57Z comes into contact with the inner face of the tip cylindrical portion 16, thus making it possible to suppress the amount of deformation of the first rod constituting portion 57.

Still further, the tip face of the first rod constituting portions 57 is given as a tip swelling face 57A which inclines in the transverse direction so as to face to the obliquely front of the lid 94 and also swells out. More specifically, as shown in FIG. 2, the tip swelling face 57A is inclined in an angular range of 30 to 45 degrees, with the lid 94 side thereof lowered backward in relation to an imaginary reference face K1 which is orthogonal to an axial direction of the first rod constituting portion 57. And, the tip swelling face 57A swells outside as a whole and is rounded.

As shown in FIG. 5, the fourth rod constituting portion 60 is structured so as to have a cylindrical column body which is substantially equal in outer diameter to the second rod constituting portion 58 and extends in the front-back direction in which the sub-plate portion 31 side is flatly cut up to a position close to the central axis to form an intermediate flat face 50A (refer to FIG. 6). In addition, the fourth rod constituting portion 60 is also provided with a streak-like side flat face 60B (refer to FIG. 5) which is orthogonal to the intermediate flat face 50A by slightly cutting both sides of the intermediate flat face 50A. Further, a plurality of rectangular holes 60C (refer to FIG. 5) for weight saving are formed on a side opposite to the intermediate flat face 50A of the fourth rod constituting portion 60.

As shown in FIG. 5, the third rod constituting portion 59 is formed in a rectangular parallelepiped shape as a whole, and a rectangular cross section thereof has a dimension which includes a circular-arc shaped cross section of the fourth rod constituting portion 60. Further, as shown in FIG. 6, one side face of the third rod constituting portion 59 is given as an intermediate flat face 50A which is formed in continuation from the fourth rod constituting portion 60. The rear end portion of the inclined face 58C of the second rod constituting portion 58 is connected to the front end portion of the intermediate flat face 50A. Further, a long-hole shaped spring locking hole 55 extending in the vertical direction is formed so as to penetrate through the third rod constituting portion 59.

In addition, as shown in FIG. 5, a slide-contact protruding strip 56B which extends in the vertical direction and has a semi-circular arc shaped cross section is formed on a side face on the groove bottom wall 15S side of the third rod constituting portion 59.

As shown in FIG. 6, the fifth rod constituting portion 61 is structured to have a receiving recessed portion 54 by cutting a part of a rectangular column which extends as a whole in the front-back direction. Further, one side face of the fifth rod constituting portion 61 is given as an intermediate flat face 50A which is formed in continuation from the third and the fourth rod constituting portion 59, 60.

The receiving recessed portion 54 is depressed from the intermediate flat face 50A in a stepwise manner and opened toward the sub-plate portion 31 and below, extending in the front-back direction. Further, the inner side face of the rear end portion of the receiving recessed portion 54 is given as the pressurized face 54A which is orthogonal to the axial direction of the rod 50. Still further, the inner side face of the receiving recessed portion 54 is formed in such a shape as to extend forward from the upper end portion of the pressurized face 54A, incline forwardly downward on its way and bend further downward. A space forward of the pressurized face 54A of the receiving recessed portion 54 is given as an interference avoiding space 54S (refer to FIG. 16B).

In addition, a step face 61D is formed at a middle point in the front-back direction on a lower face of the fifth rod constituting portion 61. A part rearward from the step face 61D is made larger downward. Further, the step face 61D is curved in a one-quarter circular-arc shape. Still further, a pair of slide-contact protruding strips 56A, 56A are formed at positions forward from the step face 61D on an upper face and a lower face of the fifth rod constituting portion 61. The upper slide-contact protruding strip 56A extends in the transverse direction and assumes a semi-circular arc shape. On the other hand, the lower slide-contact protruding strip 56A is formed so as to be symmetrical with respect to the upper slide-contact protruding strip 56A and shorter than the upper slide-contact protruding strip 56A. In addition, as shown in FIG. 5, a slide-contact protruding strip 56B similar to the above-described slide-contact protruding strip 56B of the third rod constituting portion 59 is formed at the front end portion of the fifth rod constituting portion 61 on a face facing to the groove bottom wall 15S.

As shown in FIG. 6, the sixth rod constituting portion 62 is formed in a rectangular parallelepiped shape which extends in the front-back direction as a whole. One side face of the sub-plate portion 31 side thereof is made lower than the intermediate flat face 50A in a stepwise manner and provided with a rectangular hole 62A for weight saving. Further, a switch contact portion 53 protrudes from an upper face of the sixth rod constituting portion 62. As shown in FIG. 7, the switch contact portion 53 protrudes upward from the vertical partition wall 17 and is dimensionally large enough to pass through the rod passing port 14A in the front-back direction. Still further, a front face of the switch contact portion 53 is given as a contacting front face 53A which is orthogonal to the axial direction of the rod 50. In addition, the above-described slide-contact protruding strip 56A is provided on the lower face of the sixth rod constituting portion 62. In addition, as shown in FIG. 5, on a side face of the groove bottom wall 15S side of the sixth rod constituting portion 62, the above-described slide-contact protruding strip 56B is formed from an upper end of the switch contact portion 53 to a lower end portion of the sixth rod constituting portion 62 at the front end portion thereof.

Figure 14:
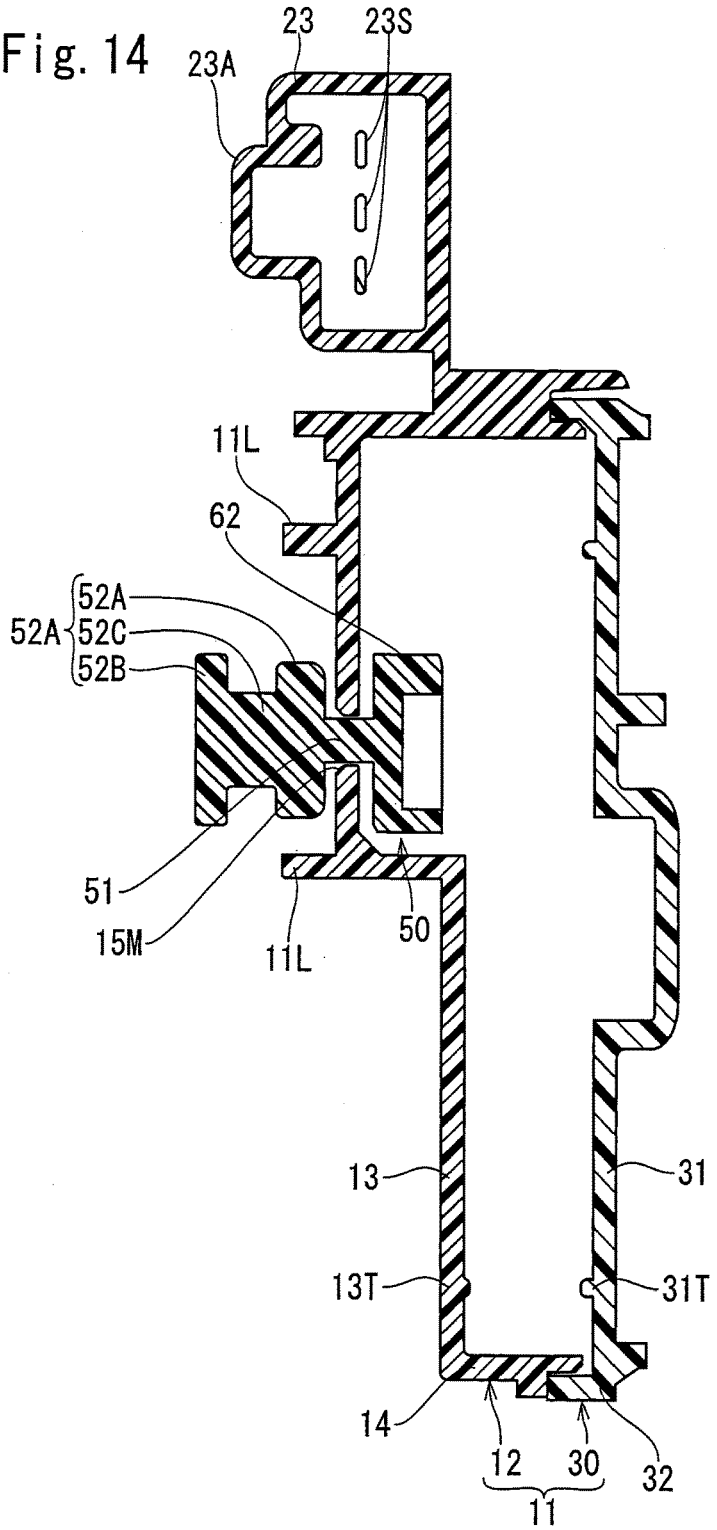
FIG. 14 is a rear cross-sectional view of a housing and a rod.

A slit through rib 51 protrudes from the side face of the sixth rod constituting portion 62 of the groove bottom wall 15S side. As shown in FIG. 9 and FIG. 14, the slit through rib 51 is disposed close to the rear end of the sixth rod constituting portion 62 at the center in the vertical direction and penetrates through the guide slit 15M.

As shown in FIG. 6, a side head portion 52 is provided at the tip of the slit through rib 51. The side head portion 52 is composed of a slide plate 52A, a relay column 52C and an operation head 52B. The slide plate 52A is formed in a rectangular substantially plate shape opposed to the sixth rod constituting portion 62 as a whole across the slit through rib 51. And, a face of the slide plate 52A which is opposed to the sixth rod constituting portion 62 is curved in such a manner as to come closer to the sixth rod constituting portion 62 toward the center in the front-back direction. Further, a face of the slide plate 52A on the opposite side of the sixth rod constituting portion 62 is bent in an angular shape in such a manner as to come closer to the operation head 52B toward the center in the front-back direction. Still further, the operation head 52B is formed in an oval shaped plate in which both front and rear end portions are curved in a circular-arc shape. In addition, the relay column 52C assumes a flat columnar shape which relays between the slide plate 52A and the operation head 52B, and the cross sectional shape thereof is formed in an oval shape which is one-size smaller than the operation head 52B.

In addition, as shown in FIG. 2, a wire W is installed on the relay column 52C and a terminal portion of the wire W is drawn out into a trunk room 96 of the vehicle 90 (refer to FIG. 1).

Figure 15A:
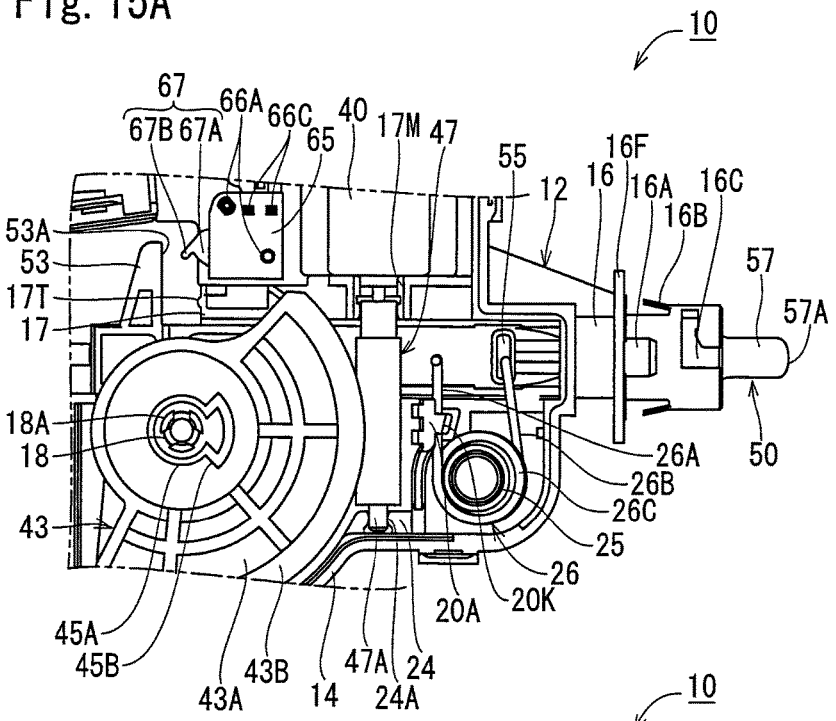
FIG. 15A is an internal side view which shows the lid locking device in a state that the rod is disposed at a locking position and the worm wheel is disposed at the forward rotation limit position.
Figure 15B:
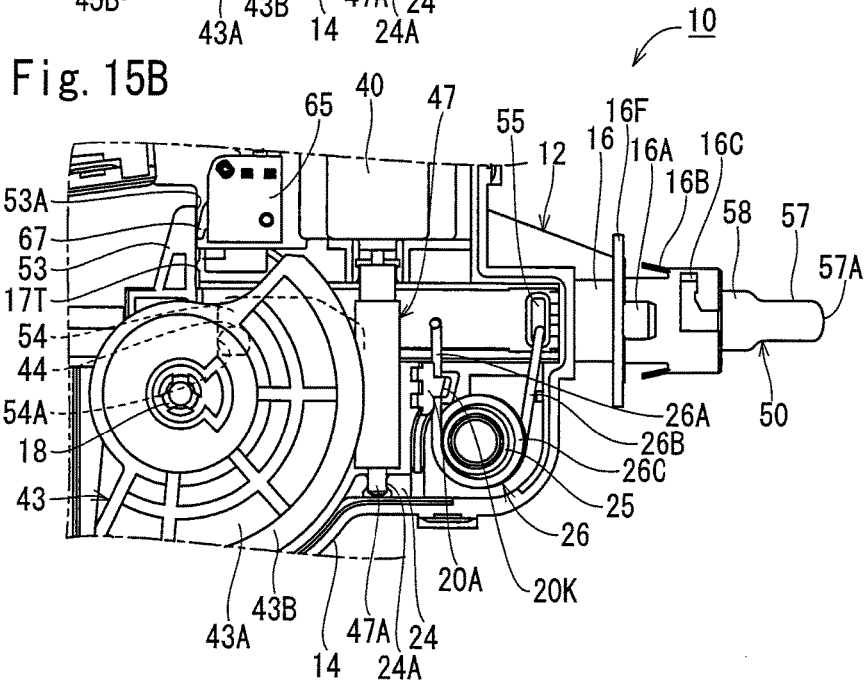
FIG. 15B is an internal side view which shows the lid locking device in a state that the rod is disposed at an origin position and the worm wheel is disposed at the forward rotation limit position.

The rod 50 is urged forward by a torsion coil spring 26 shown in FIG. 5. The torsion coil spring 26 is structured in such a manner that tips of a pair of terminal arm portions 26A, 26B jutting from both ends of a coil portion 26C are bent at a right angle in mutually opposing directions. As shown in FIG. 15B, the coil portion 26C is inserted outside the cylindrical column 25, and one of the terminal arm portions 26A is pressed toward the base end from the locking protrusion 20K on a front face of the reinforcing main portion 20A, and a tip portion of the other of the terminal arm portions 26B is assembled while inserted in the spring locking hole 55 of the rod 50.

Figure 16B:
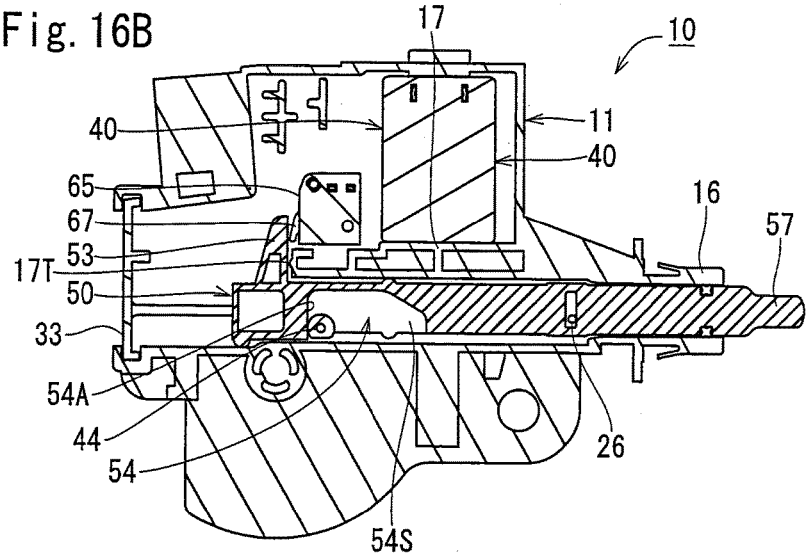
FIG. 16B is a side cross-sectional view which shows the lid locking device in a state that the rod is disposed at the origin position and the worm wheel is disposed at the forward rotation limit position.

When the lid 94 is open as shown in FIG. 16A, the rod 50 moves, as shown in FIG. 16B, only by elastic force of the torsion coil spring 26 to the origin position at which the switch contact portion 53 is in contact with the contacting protruding strip 17T at the rear end of the vertical partition wall 17. Further, as shown in FIG. 15B, the front end portion of the rod 50 disposed at the origin position is in a state of protruding forward from the tip cylindrical portion 16. When the lid 94 is closed, the tip guide portion 95C of the engagement protrusion piece 95 provided on the lid 94 presses the tip swelling face 57A at the front end of the first rod constituting portion 57 of the rod 50 to come in slide contact with the tip swelling face 57A. And, when the rod 50 is pressed backward to move backward to the unlocked position shown in FIG. 17B, the first rod constituting portion 57 of the rod 50 passes through the tip guide portion 95C and rides over a position of the rod abutting portion 95A which is close to the tip guide portion 95C in relation to the engagement recessed portion 95B.

Figure 17A:
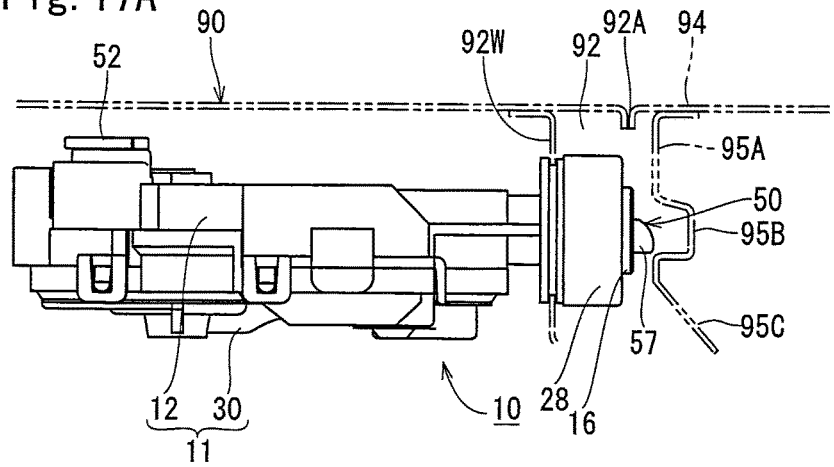
FIG. 17A is a plan view which shows the lid locking device in a state that the rod is disposed at an unlocked position.
Figure 17B:
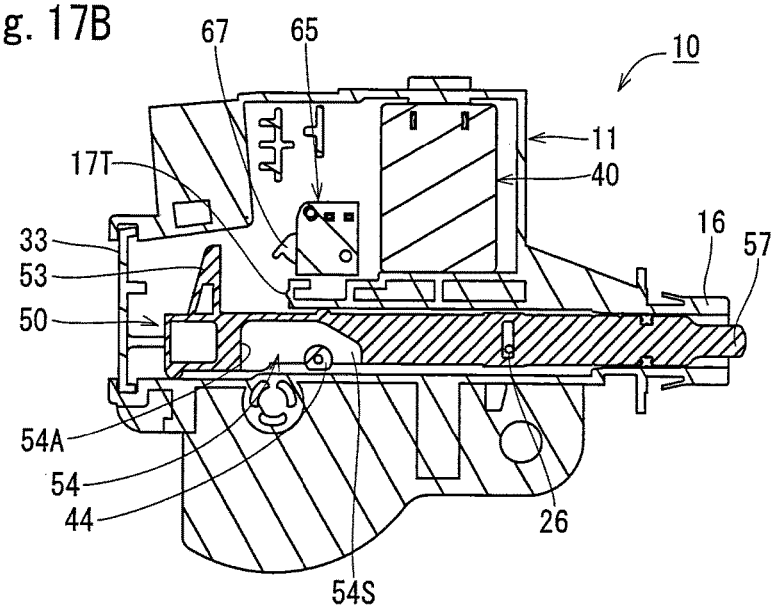
FIG. 17B is a side cross-sectional view which shows the lid locking device in a state that the rod is disposed at the unlocked position and the worm wheel is disposed at the forward rotation limit position.
Figure 18A:
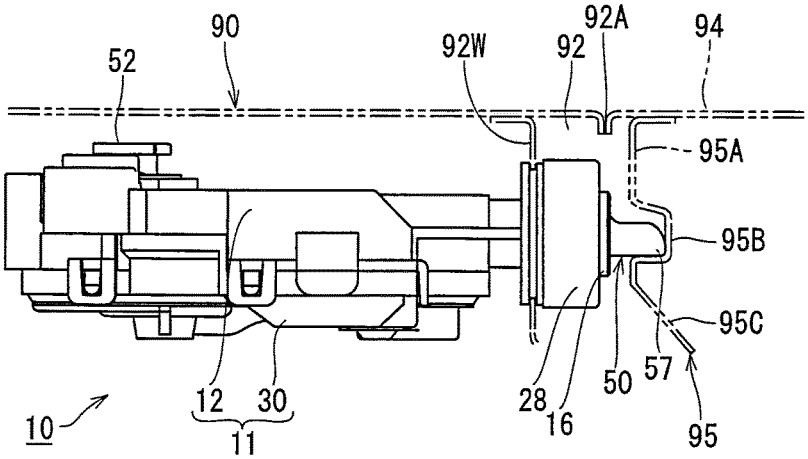
FIG. 18A is a plan view which shows the lid locking device in a state that the rod is disposed at the locking position.
Figure 18B:
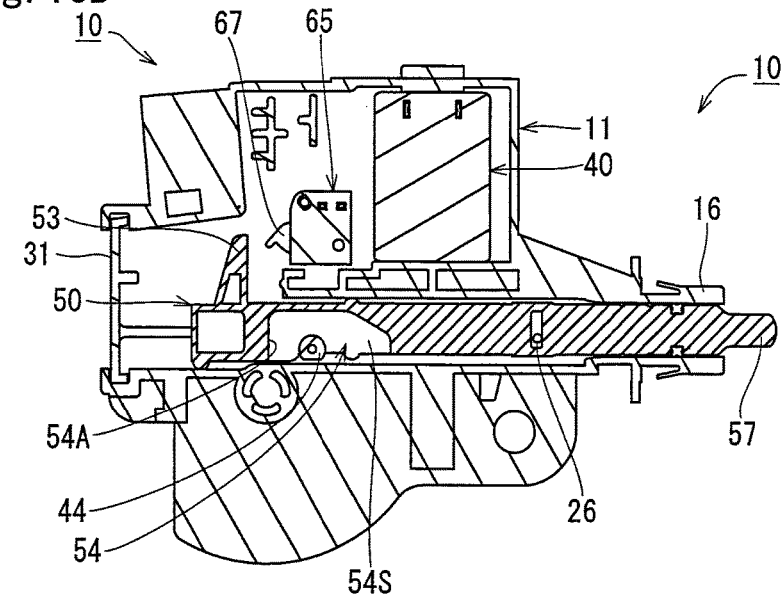
FIG. 18B is a side cross-sectional view which shows the lid locking device in a state that the rod is disposed at the locking position and the worm wheel is disposed at the forward rotation limit position.

In a totally closed state in which the lid 94 is completely closed as shown in FIG. 17A, the first rod constituting portion 57 faces the engagement recessed portion 95B, and the rod 50 moves forward by the elastic force of the torsion coil spring 26, and the first rod constituting portion 57 goes into the engagement recessed portion 95B. As shown in FIG. 18A, the tip of the first rod constituting portion 57 comes into contact with an innermost face of the engagement recessed portion 95B. As shown in FIG. 18B, the rod 50 is then positioned at the intermediate locking position between the origin position and the unlocked position.

In addition, a part rearward from a position before the first rod constituting portion 57 of the rod 50 goes into the engagement recessed portion 95B is entirely the unlocked position. Further, the side head portion 52 is operated to draw the rod 50 backward, by which the rod 50 arrives at a rear-end limit position at the rear end of the unlocked position (a position at which the rod 50 shown in FIG. 7 moves further to the left side of the drawing and is in contact with the closing protruding piece 33).

A detection switch 65 is assembled on the upper main plate portion 13A in order to monitor an open/close status of the lid 94 on the basis of linear motions of the rod 50. As shown in FIG. 6, the detection switch 65 is provided with a rectangular parallelepiped switch body 66 which is flat in the transverse direction and structured so that a sensor 67 protrudes from a rectangular hole 66B on a rear face of the switch body 66. The sensor 67 turns between an off position and an on position about a rotating shaft which passes in the transverse direction through the vicinity of the upper end portion of the rectangular hole 66B of the switch body 66. Further, the sensor 67 is integrally provided with a fan-shaped portion 67A which droops perpendicularly from the rotationally moving shaft and juts outside from the rectangular hole 66B and a contacting piece 67B which is extended on a lower extension line of an inclined side face of the fan-shaped portion 67A. The sensor 67 is urged outside the rectangular hole 66B by an elastic member (not illustrated) and normally disposed at the off position shown in FIG. 7.

As shown in FIG. 6, a pair of bus bar connection holes 66C, 66C and a pair of mounting holes 66A, 66A penetrate through the switch body 66 in the transverse direction. The pair of bus bar connection holes 66C, 66C are arrayed in the front-back direction at positions close to the upper end of the switch body 66. A second and a third bus bar 68Y, 68Z to be described later are inserted and connected to the bus bar connection holes 66C, 66C.

On the other hand, a pair of mounting holes 66A, 66A are disposed near a pair of opposing corners of the switch body 66. And, one of the mounting holes 66A is a round hole, while the other of the mounting holes 66A is formed in a long-hole shape extending in a direction in which the pair of mounting holes 66A, 66A are arrayed. The switch body 66 is provided on the main plate portion 13 in a state that a pair of sensor installation supports 21, 21 protruding from the inner face of the upper main plate portion 13A are fitted into the pair of mounting holes 66A, 66A. Further, as shown in FIG. 15A, a lower face of the switch body 66 adjoins an upper face of the vertical partition wall 17, and a rear face of the switch body 66 is disposed at a position which is shifted slightly forward from the rear end face of the vertical partition wall 17. Still further, the sensor 67 protrudes backward from the contacting protruding strip 17T in a state of being at the off position. As shown in FIG. 15B, when the rod 50 is disposed at the origin position, the switch contact portion 53 presses the sensor 67 forward up to the on position, by which the detection switch 65 is turned on. In addition, when the rod 50 moves away from the origin position toward the locking position or the unlocked position, the switch contact portion 53 moves away from the sensor 67, and the sensor 67 returns to the off position elastically, and the detection switch 65 is turned off.

As shown in FIG. 8, the first to the third bus bar 68X, 68Y, 68Z are laid sequentially from above, with an interval kept, on an inner face of the upper main plate portion 13A. More specifically, the rear end portion of each of the first to the third bus bar 68X, 68Y, 68Z extends in the front-back direction and is also arrayed in parallel, passing through the bus bar insertion slit 23S on the main side wall 14, and forming a male terminal fitting (what is called tongue piece) which protrudes from an innermost face inside the male connector hood 23.

Further, the third bus bar 68Z is formed in such a shape that is extended forward and then bent downward inside the main side wall 14. A connection piece (not illustrated) is bent in a rising manner from the lower end portion thereof, inserted and connected to the bus bar connection hole 66C of the switch body 66 which is close to the rear side thereof. Still further, the first and the second bus bar 68X, 68Y are both extended forward inside the main side wall 14 and bent in such a manner as to swell downward. And, the front parts thereof extend upward in parallel.

Connection pieces 68T, 68T shown in FIG. 5 are bent in a rising manner from a side edge portion at the upper end portion of each of the first and the second bus bar 68X, 68Y, inserted and connected to bus bar connection holes 41, 41 of a motor 40 to be described later. Further, a branching piece 68J extends in such a manner as to get into between the switch body 66 and the upper main plate portion 13A from a middle portion of the second bas bar 68Y. And, a connection piece (not illustrated) formed by bending in a rising manner the tip of the branching piece 68J is inserted and connected to the bus bar connection hole 66C at the front side of the switch body 66. The sensor 67 is disposed at the on position, by which electricity is conducted between the second and the third bus bar 68Y, 68Z. On the other hand, the sensor 67 is disposed at the off position, by which electricity is cut off between the second and the third bus bar 68Y, 68Z.

As shown in FIG. 6, a partition wall 13X which separates the first bus bar 67X from the second bus bar 68Y and a partition wall 13Y which separates the second bus bar 68Y from the the third bus bar 68Z protrude on the inner face of the upper main plate portion 13A. Further, a positioning hole 68A is formed at each of the first to the third bus bar 68X, 68Y, 68Z. A plurality of bus bar positioning protrusions 22 which protrude from the inner face of the upper main plate portion 13A are fitted into the positioning holes 68A.

In addition, the first to the third bus bar 68X, 68Y, 68Z are assembled on the main housing 12, together with the detection switch 65 in a state that they are integrated by a bridging wall 68K and also the second and the third bus bar 68Y, 68Z are connected to the detection switch 65. The motor 40 to be described later is assembled on the main housing 12, and the bridging wall 68K is removed after the first and second bus bar 68X, 68Y are connected to the motor 40.

The motor 40 is assembled on the housing 11 as a drive source allowing the rod 50 to move backward, and power of the motor 40 is transmitted to the rod 50 by way of the worm gear 47 and the worm wheel 43. More specifically, the motor 40 is assembled at the front of the detection switch 65 in the main housing 12 in a state that the rotating shaft is oriented in the vertical direction. Further, an output rotating shaft 40S (refer to FIG. 7) protrudes from the center of the lower end face of the motor 40, to which the worm gear 47 is fixed so as to rotate in an integral manner. Further, as shown in FIG. 5, a pair of parallel flat faces are provided on a lateral part of the motor 40, and the above-described connection pieces 68T, 68T of the first and the second bus bar 68X, 68Y are inserted and connected to the pair of bus bar connection holes 41, 41 provided on an upper end side of one of the flat faces. Still further, a back face protrusion portion 40T protrudes from the center of the base end face of the motor 40 and is received by motor positioning recessed portions 14M, 32M which are formed on the respective inner faces of the main side wall 14 and the sub-side wall 32. In addition, as shown in FIG. 7, a front protrusion portion 40U protrudes from a periphery of the output rotating shaft 40S on the tip face of the motor 40 and is received by the motor positioning groove 17M which is formed on the vertical partition wall 17.

The worm gear 47 extends downward from the motor positioning groove 17M, coming across the guide groove portion 15, and is butted against the inner face of the lower main plate portion 13B adjacently behind the reinforcing wall 20. Further, adjacently behind the reinforcing wall 20 in the lower main plate portion 13B, a pair of worm holding portions 24, 24 are arrayed in the front-back direction along the inner face of the main side wall 14. A center shaft 47A which protrudes from the center of the tip face of the worm gear 47 is held between the pair of worm holding portions 24, 24 and regulated for forward and backward movement. In addition, circular-arc protrusion portions 24A, 24A having a semi-circular cross section protrude from opposing faces of the worm holding portions 24,24 so as to come close to each other. And, these circular arc protrusion portions 24A, 24A are in point contact with the center shaft 47A.

As shown in FIG. 6, the worm wheel 43 is provided with a turning plate 43F formed by extending a fan-shaped plate portion 43A from a circular plate portion 43E. Further, a reinforcing rib 43L slightly protrudes on both front and rear sides of the fan-shaped plate portion 43A.

A main circular-arc side wall 43B which is formed by curving a band plate in a circular-arc shape continues to a circular-arc portion of an outer edge of the fan-shaped plate portion 43A, and a gear portion 43G is formed on an outer circumferential face of the main circular-arc side wall 43B. Further, a sub-circular arc side wall 43M which is formed by curving a band plate in a circular-arc shape smaller than the main circular-arc side wall 43B continues to a circular-arc portion of an outer edge of the circular plate portion 43E. Still further, connecting side walls 43C, 43C extending so as to connect between one ends of the sub-circular arc side wall 43M and the main circular arc side wall 43 and between the other ends of sub-circular arc side wall 43M and the main circular arc side wall 43B are connected to both straight-line portions of outer edges of the fan-shaped plate portion 43A.

Further, the main circular-arc side wall 43B, the sub-circular arc side wall 43M and the connecting side walls 43C, 43C are all equal in width, and also side faces on both sides in the width direction are flush with each other. As shown in FIG. 10, the slide-contact circular-arc protruding strips 13T, 31T contact with or adjoin so as to be contactable with both side faces of the main circular-arc side wall 43B, thereby preventing lateral displacement of the worm wheel 43.

A oddly-shaped tubular wall 45 is integrally formed on a central part of the circular plate portion 43E so as to penetrate therethrough. The oddly-shaped tubular wall 45 is formed in such a shape that a fan-shaped tubular portion 45B having a fan-shaped cross section protrudes from a part of a circumferential face of a cylindrical portion 45A, and the interior of the cylindrical portion 45A is communicatively connected with the interior of the fan-shaped tubular portion 45B. Further, as shown in FIG. 5, one end face of the oddly-shaped tubular wall 45 is closed by a bottom wall 45C, and a through hole 43H is formed at the center of the cylindrical portion 45A in the bottom wall 45C. As shown in FIG. 10, the gear supporting shaft 18 is inserted from the bottom wall 45C into the cylindrical portion 45A of the oddly-shaped tubular wall 45 through the through hole 43H, and also the center protrusion portion 35 of the sub-housing 30 is inserted into an opening on the opposite side of the bottom wall 45C in the cylindrical portion 45A. As a result, the worm wheel 43 is rotatably supported to the housing 11, and the gear portion 43G is positioned in a state of meshing with the worm gear 47. In addition, the circular-arc protrusion piece 34 of the sub-housing 30 (refer to FIG. 5) is overlaid on an outer circumferential face of the fan-shaped tubular portion 45B of the oddly-shaped tubular wall 45 (refer to FIG. 6).

As shown in FIG. 5 and FIG. 6, the turning plate 43F is disposed at a position close to the sub-plate portion 31 in the width direction of the main circular-arc side wall 43B, the connecting side wall 43C or the like. A pair of rotational movement regulating walls 43D, 43D are formed adjacent to the pair of connecting side walls 43C, 43C at a region of the worm wheel 43 which is closer to the main plate portion 13 than the swing plate 43F and surrounded by the main circular-arc side wall 43B and the connecting side walls 43C, 43C.

Figure 12:
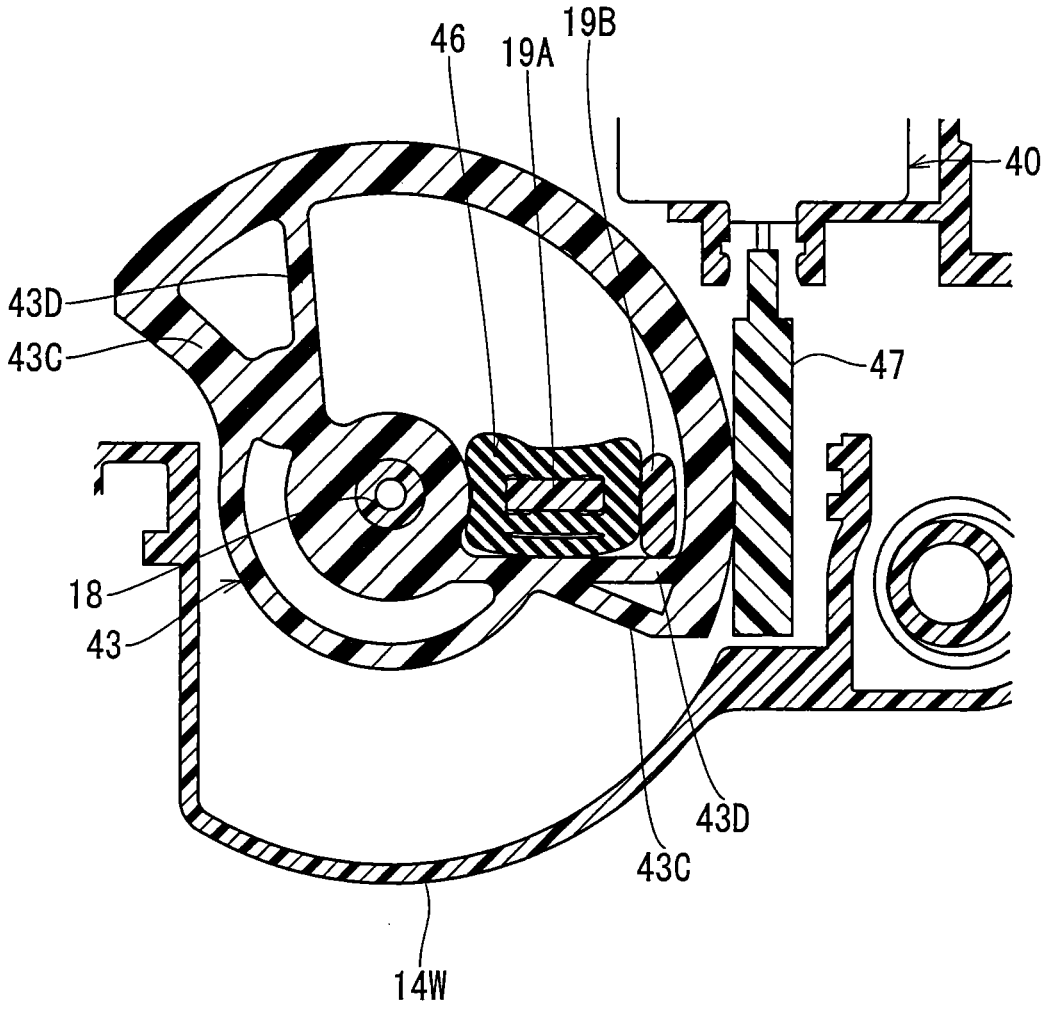
FIG. 12 is a side cross-sectional view of the lid locking device in a state that the worm wheel is disposed at a backward rotation limit position.

As shown in FIG. 11, the pair of rotational movement regulating walls 43D, 43D extend so as to be substantially orthogonal to each other and are disposed in such a manner that an intersection point thereof is positioned on the opposite side of the main circular arc side wall 43B in relation to the center of rotational movement of the worm wheel 43. The above-described first and the second rotational movement regulating protrusions 19A, 19B and the cushion rubber 46 are accommodated between the pair of rotational movement regulating walls 43D, 43D. The worm wheel 43 turns in a clockwise direction when viewed from the sub-plate portion 31, by which one of the rotational movement regulating walls 43D takes a horizontal posture and comes in contact with the cushion rubber 46 from above and the worm wheel 43 is positioned at the forward rotation limit position. On the other hand, the worm wheel 43 turns in a counter-clockwise direction when viewed from the sub-plate portion 31, by which, as shown in FIG. 12, the other of the rotational movement regulating walls 43D takes a substantially horizontal posture and comes in contact with the cushion rubber 46 from below and the worm wheel 43 is positioned at the backward rotation limit position.

As shown in FIG. 11, the rotational movement regulating wall 43D at which the worm wheel 43 is in contact with the cushion rubber 46 at the forward rotation limit position and an end portion close to the center of rotation of the connecting side wall 43C are connected by a complementary portion 43N. A pressurizing protrusion portion 44 (refer to FIG. 5) protrudes from the complementary portion 43N toward the inside of the receiving recessed portion 54 of the rod 50 (refer to FIG. 6). The pressurizing protrusion portion 44 is provided with a flat face at a part of the circumferential face of the cylindrical body, and when the worm wheel 43 is positioned at the forward rotation limit position, the flat face of the pressurizing protrusion portion 44 adjoins or comes in contact with the lower groove side wall 15B from above. Further, at this time, when the rod 50 is disposed at the origin position as shown in FIG. 15B and FIG. 16B, the pressurizing protrusion portion 44 is in a state of being adjacent to a pressurized face 54A at the rear end of the receiving recessed portion 54.

A description has been so far given of the configuration of the lid locking device 10 of the present embodiment as well as that of the lid locking mechanism which is composed of the lid locking device 10 and the engagement protrusion piece 95. Next, a description will be given of operation and effects of the lid locking device 10 and the lid locking mechanism. The lid 94 of the vehicle 90 is normally closed. Therefore, as shown in FIG. 18A, the rod 50 is normally engaged with the engagement recessed portion 95B of the engagement protrusion piece 95 provided on the lid 94 and disposed at the locking position, and as shown in FIG. 18B, the detection switch 65 is kept off. Further, as shown in FIG. 11, the worm wheel 43 is disposed at the forward rotation limit position, and the pressurizing protrusion portion 44 is positioned at the front apart from the pressurized face 54A, as shown in FIG. 18B.

In fueling, for example, a lid open switch provided inside the vehicle 90 is operated to open the lid 94. Then, direct current for backward rotation is supplied to the motor 40 only for a predetermined first conducting time. The worm wheel 43 rotates backward and turns from the forward rotation limit position to the backward rotation limit position.

In addition, the vehicle 90 on which the lid locking device 10 of the present invention is mounted may be such that supply of electricity to the motor 40 is started immediately after operation of the lid open switch. Further, the vehicle may be such that, for example, upon operation of the lid open switch, a pressure device inside a fuel tank is first activated to decrease the internal pressure of the fuel tank to a specified pressure so that gasified gasoline in excess of a specified quantity is not discharged when the lid 94 is opened and supply of electricity to the motor 40 is thereafter started as in a vehicle which meets the evaporative emission standard.

The worm wheel 43 turns from the forward rotation limit position to the backward rotation limit position, by which the pressurizing protrusion portion 44 moves backward, comes into contact with the pressurized face 54A of the rod 50 on its way, thereby imparting a backward driving power allowing the rod 50 to move backward to the pressurized face 54A. In other words, the pressurizing protrusion portion 44 presses the pressurized face 54A backward, by which the rod 50 moves backward. Before the worm wheel 43 arrives at the backward rotation limit position, the rod 50 arrives at the unlocked position and the lid 94 is opened outward by elastic force of an elastic member (not illustrated).

Even after arrival of the rod 50 at the unlocked position, the worm wheel 43 further rotates backward and arrives at the backward rotation limit position, as shown in FIG. 7. Accordingly, the rod 50 moves to just before the rear-end limit position at the unlocked position. As shown in FIG. 12, the above-described first conducting time elapses while the worm wheel 43 is stopped at the backward rotation limit position by the contact with the cushion rubber 46. And, this time, direct current for forward rotation is supplied to the motor 40 only for a predetermined second conducting time. As a result, the worm wheel 43 rotates reversely (in other words, rotates forward), turning from the backward rotation limit position to the forward rotation limit position and the pressurizing protrusion portion 44 moves forward. The rod 50 moves forward in such a manner that the pressurized face 54A follows the pressurizing protrusion portion 44 by spring force of the torsion coil spring 26. At this time, since the lid 94 is opened, the rod 50 moves to the origin position. As shown in FIG. 15B, the switch contact portion 53 of the rod 50 presses the sensor 67 of the detection switch 65 forward, and the detection switch 65 is turned on. In response to the turning on of the detection switch 65, for example, a warning lamp inside the vehicle 90 is turned on.

Figure 19A:
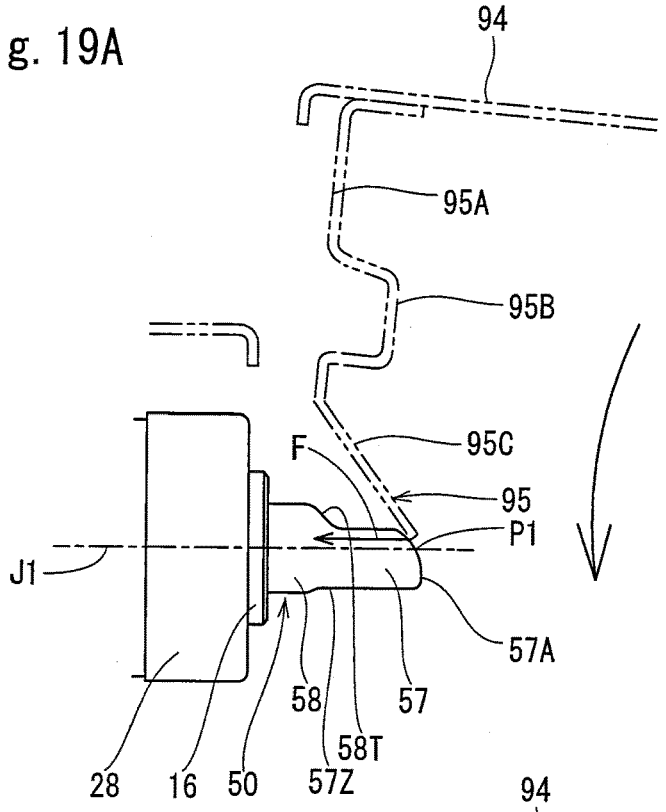
FIG. 19A is a plan view in which the rod starts to come in slide contact with a tip guide portion.

Now, after fueling, the lid 94 is pushed manually and moved to the closed position. As shown in FIG. 19A, the tip guide portion 95C of the engagement protrusion piece 95 provided on the lid 94 then comes into contact with the tip swelling face 57A of the first rod constituting portion 57 of the rod 50. The lid 94 is pressed in this state, by which as shown in the change from FIG. 19A to FIG. 19B, the tip guide portion 95C presses the tip swelling face 57A of the first rod constituting portion 57 and comes in slide contact with the tip swelling face 57A. A force which presses the lid 94 is changed to the axial force F which is directed to the axial direction of the rod 50, and the rod 50 moves backward toward the unlocked position. In addition, when the rod 50 moves backward, the detection switch 65 is turned off and a warning lamp inside the vehicle 90 is turned off.

Figure 19B:
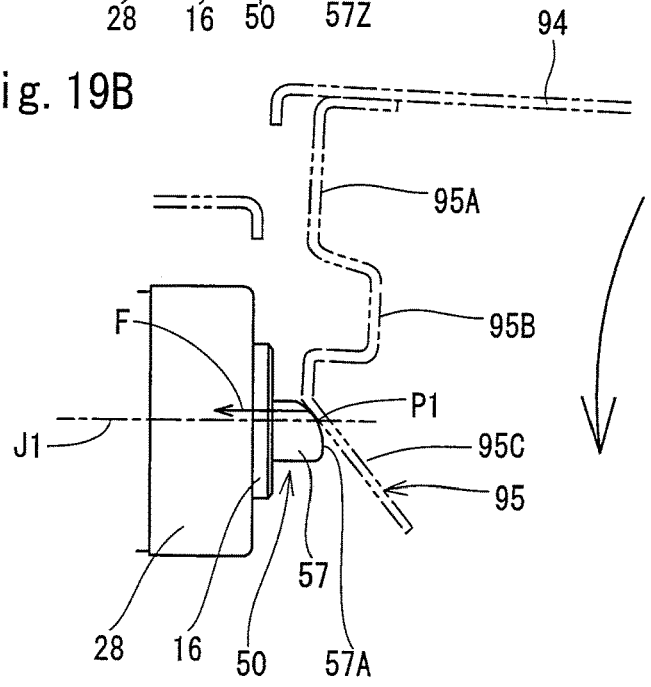
FIG. 19B is a plan view in which the rod terminates the sliding contact with the tip guide portion.

Here, in the lid locking device 10 of the present embodiment and the lid locking mechanism, as shown in FIG. 9, the first rod constituting portion 57 at the front end of the rod 50 is eccentrically located on a side away from the lid 94, of the forward extending region of the second rod constituting portion 58 which is linearly movably supported at the tip cylindrical portion 16 of the rod 50. Accordingly, as shown in FIG. 19A and FIG. 19B, even where the engagement protrusion piece 95 presses a side of the tip swelling face 57A of the first rod constituting portion 57 which is close to the lid 94, the device and the mechanism of the present invention are able to receive the axial force F derived from pressing force at a position closer to the central axis J1 of the second rod constituting portion 58 than conventionally structured ones and also the resistance on operation of closing the lid 94 becomes smaller than before. Further, the tip swelling face 57A at the tip of the first rod constituting portion 57 is formed so as to swell out and come in point contact with the engagement protrusion piece 95. Therefore, the tip swelling face 57A slides easily to suppress sliding resistance, which also contributes to a decreased resistance on the closing operation. Still further, since the first rod constituting portion 57 is thinner than the second rod constituting portion 58, it is possible to suppress a variation in sliding contact position in relation to the engagement protrusion piece 95 at the tip of the first rod constituting portion 57. In addition, upon backward movement of the first rod constituting portion 57, the hole-inner face opposing portion 57Z of the first rod constituting portion 57 adjoins the inner face of the tip cylindrical portion 16 (refer to FIG. 13). Therefore, if the first rod constituting portion 57 is pressed by the engagement protrusion piece 95 and deformed, the hole-inner face opposing portion 57Z comes into contact with the inner face of the tip cylindrical portion 16. Accordingly, it is possible to suppress the amount of deformation of the first rod constituting portion 57.

Figure 20A:
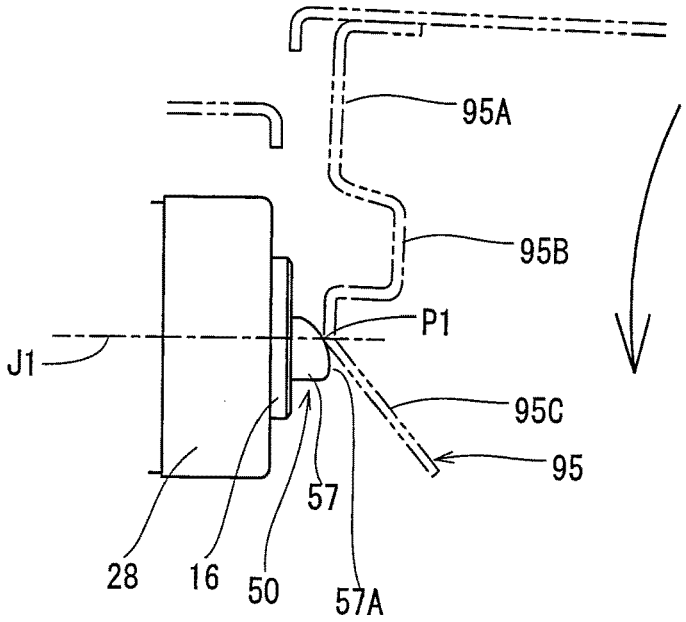
FIG. 20A is a plan view in which the rod rides over a rod abutting portion.
Figure 20B:
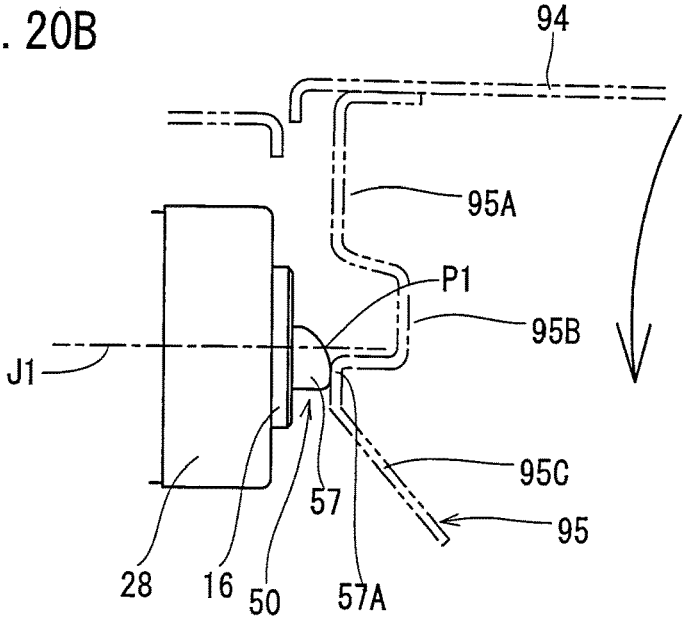
FIG. 20B is a plan view in which the rod terminates the sliding contact with the rod abutting portion.
Figure 21:
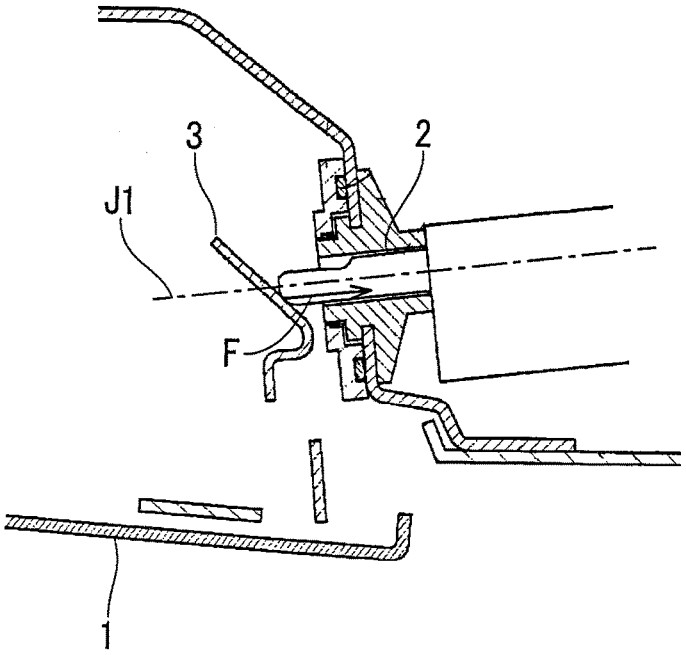
FIG. 21 is an internal side view which shows a conventional lid locking device.

After the lid 94 is further pressed, a corner of the engagement protrusion piece 95 between the tip guide portion 95C and the rod abutting portion 95A comes in slide contact with the tip swelling face 57A in due course as shown in FIG. 20A. A slide contact point thereof passes through an axial intersection 21 of the tip swelling face 57A with which the central axis J1 of the second rod constituting portion 58 intersects, and arrives at the front end portion of the tip swelling face 57A. The first rod constituting portion 57 then rises over a position of the rod abutting portion 95A which is closer to the tip guide portion 95C than the engagement recessed portion 95B, and the rod 50 arrives at the unlocked position shown in FIG. 20B. When the lid 94 is further pressed in this state, the rod abutting portion 95A comes into contact with the front end position of the tip swelling face 57A which is spaced away to the greatest extent from the central axis J1 of the second rod constituting portion 58. However, the rod 50 will not move backward or will move backward only slightly due to the contact between the rod abutting portion 95A and the first rod constituting portions 5. Thus, any chance of an increase in resistance on operation of closing the lid 94 is excluded by the rod abutting portion 95A coming into contact with the front end position of the tip swelling face 57A which is spaced away to the greatest extent from the central axis of the second rod constituting portion 58.

As shown in FIG. 17A, when the lid 94 is completely closed to be in a totally closed state, the first rod constituting portions 57 of the rod 50 faces the engagement recessed portion 95B, and the rod 50 moves forward by spring force of the torsion coil spring 26. As shown in FIG. 18A, the tip of the first rod constituting portion 57 comes into contact with an innermost face of the engagement recessed portion 95B, and the rod 50 is positioned at the locking position shown in FIG. 18B. As a result, a normal state before fueling is restored.

In addition, where the lid 94 cannot be unlocked by switch operation inside the vehicle 90 due to defects of the motor 40 or the like, the wire W is pulled within the trunk room 96, allowing the rod 50 to move from the locking position to the unlocked position, by which the lid 94 can be opened.

Other Embodiments

The present invention shall not be limited to the embodiments so far described. For example, embodiments which will be described as follows are also included in a technical scope of the present invention. In addition, other than the following, the present invention may be modified in various ways without departing from the gist of the present invention.

(1) The lid locking device 10 of the above-described embodiment is used to lock the lid 94 which closes the recessed portion 92 having the fuel filler opening 91 at an innermost part. The present invention may be applicable to, for example, a power receiving connector for charging batteries of an electric vehicle, a hydrogen fuel filler opening of a fuel-cell vehicle and other lid locking device for locking a lid which closes an opening of a recessed portion having an energy obtaining portion at an innermost side. The present invention may also be applicable to a lid locking device which locks a lid other than an energy obtaining portion of a vehicle.

(2) The above-described embodiment is arranged in such a manner that the rod 50 of the lid locking device 10 moves forward to the front of the vehicle 90 and is engaged with the engagement protrusion piece 95 of the lid 94. Such an arrangement is also acceptable that the rod 50 of the lid locking device 10 moves forward to the rear, upward or downward position of vehicle 90 and is engaged with the lid 94. That is, in the present invention, "front" or "forward" contained in expressions such as "front end portion," "move forward" or "forward extending region" expresses, for the sake of convenience, one direction in which the rod moves, whereas "rear" or "backward" contained in expressions such as "move backward" expresses a direction opposite to the above-described expression of "front" or "forward." And, these expressions such as "front" "forward," "rear" and "backward" have nothing to do with the front and the rear of a vehicle.

(3) In the above-described embodiment, the tip swelling face 57A which is the tip face of the first rod constituting portion 57 inclines in relation to the central axis of the first rod constituting portion 57. It is, however, acceptable that the tip face of the first rod constituting portion 57 is orthogonal to the central axis of the first rod constituting portion 57. It is also acceptable that the entire tip face of the first rod constituting portions 57 is directed to a direction which is orthogonal to the central axis of the first rod constituting portion 57 and formed so as to swell out and a swollen-out apex thereof is disposed on the central axis J1 of the second rod constituting portion 58. Then, the tip guide portion 95C and the rod abutting portion 95A are allowed to be slide-contacted mainly with an axial intersection of the tip face of the first rod constituting portion 57 which intersects with the central axis J1 of the second rod constituting portion 58.

(4) In the above-described embodiment, the first and the second rod constituting portions 57, 58 corresponding to the engagement rod portion and the supporting rod portion of the present invention are both formed so as to have a circular cross section. It is, however, acceptable that both or one of the engagement rod portion and the supporting rod portion are formed so as to have the other shape of cross section, for example, a rectangular cross section.

DESCRIPTION OF REFERENCE NUMERALS

10: lid locking device
11: housing
16H: support hole
50: rod
57: first rod constituting portion (engagement rod portion)
57A: tip swelling face
57Z: hole-inner face opposing portion
58: second rod constituting portion (supporting rod portion)
58T: diameter reducing portion
90: vehicle
94: lid
95: engagement protrusion piece (locking engaging portion)
95A: rod abutting portion
95B: engagement recessed portion
95C: tip guide portion
F: axial force
J1: central axis
P1: axial intersection

What is claimed is:

1. A lid locking device, comprising:

a housing fixed on a vehicle and provided with a support hole having a circular shape;

a rod which is linearly movably assembled to the housing and urged forward and a front end portion thereof is, in a process of closing a lid of the vehicle, pressed by a locking engaging portion provided on the lid, moving backward to an unlocked position, then, moving forward to a locking position and making an engagement with the locking engaging portion, thereby locking the lid in a closed state;

a supporting rod portion which is provided at an intermediate portion of the rod in an axial direction and linearly movably supported on the support hole, the supporting rod portion having a circular cross section;

an engagement rod portion which is provided as the front end portion of the rod, thinner than the supporting rod portion, eccentrically located on a side of a forward extending region of the supporting rod portion which is spaced away from the lid, and at least partially overlapped with the central axis of the supporting rod portion;

an opposed flat face provided in the housing and opposed from a lid side to a side face of the rod at a position more rearward than the supporting rod portion; and a slide-contact protruding strip protruding from the side face of the rod located more rearward than the supporting rod portion so as to contact the opposed flat face and extending in a direction parallel to the opposed flat face and also perpendicular to the axial direction of the rod.

2. The lid locking device according to claim 1, further comprising:

a hole-inner face opposing portion which is provided at the engagement rod portion and enters into the support hole, and adjoins or comes in contact with an inner face of the support hole.

3. The lid locking device of claim 2, further comprising:

the supporting rod portion and the engagement rod portion being circular in cross section; and a diameter reducing portion in which a front end portion of the supporting rod portion is gradually reduced in diameter toward an end of the engagement rod portion.

4. The lid locking device according to claim 2, further comprising:

a tip swelling face which is provided at the front end of the engagement rod portion, inclines in relation to the axial direction of the engagement rod portion so as to face to an outer face of the vehicle and is curved outward.

5. A lid locking mechanism composed of the lid locking device according to claim 2 and the lid, the lid locking mechanism, comprising:

in a process of closing the lid, the locking engaging portion pressing the engagement rod portion so as to pass through an axial intersection with which the central axis of the supporting rod portion intersects on the front end face of the engagement rod portion.

6. The lid locking device according to claim 3, further comprising:

the diameter reducing portion is annular and surrounds an entire base end portion of the engagement rod portion.

7. The lid locking device according to claim 3, further comprising:

a tip swelling face which is provided at the front end of the engagement rod portion, inclines in relation to the axial direction of the engagement rod portion so as to face to an outer face of the vehicle and is curved outward.

8. The lid locking device according to claim 6, further comprising:

a tip swelling face which is provided at the front end of the engagement rod portion, inclines in relation to the axial direction of the engagement rod portion so as to face to an outer face of the vehicle and is curved outward.

9. The lid locking device of claim 1, further comprising:

the supporting rod portion and the engagement rod portion being circular in cross section; and a diameter reducing portion in which a front end portion of the supporting rod portion is gradually reduced in diameter toward an end of the engagement rod portion.

10. The lid locking device according to claim 9, further comprising:

the diameter reducing portion is annular and surrounds an entire base end portion of the engagement rod portion.

11. The lid locking device according to claim 9, further comprising:

a tip swelling face which is provided at the front end of the engagement rod portion, inclines in relation to the axial direction of the engagement rod portion so as to face to an outer face of the vehicle and is curved outward.

12. A lid locking mechanism composed of the lid locking device according to claim 9 and the lid, the lid locking mechanism, comprising:

in a process of closing the lid, the locking engaging portion pressing the engagement rod portion so as to pass through an axial intersection with which the central axis of the supporting rod portion intersects on the front end face of the engagement rod portion.

13. The lid locking device according to claim 10, further comprising:

a tip swelling face which is provided at the front end of the engagement rod portion, inclines in relation to the axial direction of the engagement rod portion so as to face to an outer face of the vehicle and is curved outward.

14. A lid locking mechanism composed of the lid locking device according to claim 10 and the lid, the lid locking mechanism, comprising:

in a process of closing the lid, the locking engaging portion pressing the engagement rod portion so as to pass through an axial intersection with which the central axis of the supporting rod portion intersects on the front end face of the engagement rod portion.

15. The lid locking device according to claim 1, further comprising:

a tip swelling face which is provided at the front end of the engagement rod portion, inclines in relation to the axial direction of the engagement rod portion so as to face to an outer face of the vehicle and is curved outward.

16. A lid locking mechanism composed of the lid locking device according to claim 15 and the lid, the lid locking mechanism, comprising:

in a process of closing the lid, the locking engaging portion pressing the engagement rod portion so as to pass through an axial intersection with which the central axis of the supporting rod portion intersects on the front end face of the engagement rod portion.

17. A lid locking mechanism composed of the lid locking device according to claim 1 and the lid, the lid locking mechanism, comprising:

in a process of closing the lid, the locking engaging portion pressing the engagement rod portion so as to pass through an axial intersection with which the central axis of the supporting rod portion intersects on the front end face of the engagement rod portion.

18. The lid locking device according to claim 1, further comprising:

a protrusion portion protruding to be parallel to the opposed flat face, the protruding portion forming the rod at the position more rearward than the supporting rod portion, and the slide-contact protruding strip is extending from the side face of the rod over to a side face of the protrusion portion.

19. The lid locking device according to claim 1, wherein the slide-contact protruding strip has a semi-circular arc cross section.

20. A lid locking device, comprising:

a housing which is arranged so as to be fixed on a vehicle and provided with a support hole having a circular shape;

a rod which is linearly movably assembled to the housing and urged forward and a front end portion thereof is, in a process of closing a lid of the vehicle, pressed by a locking engaging portion provided on the lid, moving backward to an unlocked position, then, moving forward to a locking position and making an engagement with the locking engaging portion, thereby locking the lid in a closed state;

a supporting rod portion which is provided at an intermediate portion of the rod in an axial direction and linearly movably supported on the support hole, the supporting rod portion having a circular cross section;

an engagement rod portion which is provided as the front end portion of the rod, thinner than the supporting rod portion, a central axis of the engagement rod portion is shifted to a side away from the lid in relation to a central axis of the supporting rod portion;

an opposed flat face provided in the housing and opposed from a lid side to a side face of the rod at a position more rearward than the supporting rod portion; and a slide-contact protruding strip protruding from the side face of the rod located more rearward than the supporting rod portion so as to contact the opposed flat face and extending in a direction parallel to the opposed flat face and also perpendicular to the axial direction of the rod.

* * * * *